US012264473B1

(12) United States Patent
Cechini

(10) Patent No.: US 12,264,473 B1
(45) Date of Patent: Apr. 1, 2025

(54) PARAPET BRACKET AND METHOD OF USING THEREOF

(71) Applicant: RESTCO ROOFING, INC., Laguna Hills, CA (US)

(72) Inventor: Craig John Cechini, Laguna Hills, CA (US)

(73) Assignee: RESTCO ROOFING, INC., Laguna Hills, CA (US)

( * ) Notice: Subject to any disclaimer, the term of this patent is extended or adjusted under 35 U.S.C. 154(b) by 0 days.

(21) Appl. No.: 18/830,328

(22) Filed: Sep. 10, 2024

(51) Int. Cl.
*E04B 1/38* (2006.01)
*E04B 7/18* (2006.01)

(52) U.S. Cl.
CPC ..... *E04B 1/388* (2023.08); *E04B 7/18* (2013.01); *E04B 2001/389* (2023.08)

(58) Field of Classification Search
CPC ..... E04B 1/388; E04B 7/18; E04B 2001/389; F16B 2/12
See application file for complete search history.

(56) References Cited

U.S. PATENT DOCUMENTS 1,745,058 A * 1/1930 Rossi ..... E04B 1/388 52/713
3,053,494 A 9/1962 Stoll
3,620,331 A 11/1971 Shaw
4,367,857 A 1/1983 McCarthy
9,601,036 B2 3/2017 Barnard, IV
11,982,127 B2 * 5/2024 Lajoie ..... E06C 7/488
2013/0168184 A1 7/2013 Tyler
2021/0002892 A1 * 1/2021 Putnam ..... E04G 21/24

FOREIGN PATENT DOCUMENTS

CN 214579345 U 11/2021
JP 8326249 A 12/1996
KR 20120059468 A * 6/2012
KR 20140136816 A 12/2014

* cited by examiner

*Primary Examiner* — Eret C McNichols
(74) *Attorney, Agent, or Firm* — DANE IP Law PC

(57) ABSTRACT

A parapet bracket is disclosed that may be mounted on a parapet wall of a roof without the usage of fasteners. The parapet bracket may be used to attach utility pipes to the parapet wall without using fasteners directly on the parapet wall. The parapet bracket may have a short leg, long leg, and a connecting plate between the two legs that form an inverted U-shape. The short leg may be used to hook the parapet bracket on the parapet wall, and the long leg may be used to couple pipes to the parapet bracket. Consequently, the pipes may be mounted to the parapet wall indirectly and without having to pierce the parapet wall with fasteners, such as screws and nails.

14 Claims, 22 Drawing Sheets

PARAPET BRACKET AND METHOD OF USING THEREOF

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various aspects and embodiments described herein relate to a parapet bracket and method of using thereof.

Commercial, industrial, and even some residential buildings have roof decks that are surrounded by a vertical parapet wall. Such parapet wall may serve multiple purposes, such as being a protection barrier to prevent people from slipping and falling off the roof. Another purpose of the parapet wall may be to hang components thereon.

Accordingly, there is a need in the art for an improved device, system, and method for utilizing the parapet wall of a roof.

BRIEF SUMMARY

The various embodiments and aspects disclosed herein address the needs discussed above, discussed below and those that are known in the art.

A parapet bracket is disclosed that may be mounted on a parapet wall of a roof without the usage of fasteners that penetrate the parapet wall. The parapet bracket may be used to attach utility pipes (e.g., gas, water, electric) to the parapet wall without using fasteners that penetrate the the parapet wall. As a result, the parapet bracket and the pipes may not leave any markings, holes, or cracks on the parapet wall when they are attached and detached to such wall. The parapet bracket may have a short leg, long leg, and a connecting plate between the short and long legs that form an inverted U-shape. The short leg may be used to hook the parapet bracket on the parapet wall, and the long leg may be used to couple pipes to the parapet bracket. Consequently, the pipes may be mounted to the parapet wall indirectly and without having to pierce the parapet wall with fasteners, such as screws and nails. The connecting plate may come in two parts such that its length may be adjustable to match different thicknesses of different parapet walls. The parapet bracket may also be used to mount other components, such as an electric box, to the parapet wall other than pipes.

In particular, a method of renovating a parapet of a roof and using a parapet bracket to reattach a pipe to the parapet is disclosed that may include removing the pipe from an interior surface of the parapet, the interior surface facing a roof deck of the roof, cleaning the interior surface of the parapet, coating the interior surface of the parapet with a weather-resistant coating, hanging the parapet bracket on the parapet such that a long leg of the parapet bracket hangs vertically along the interior surface of the parapet, a connecting plate of the parapet bracket that is connected to the long leg lays horizontally on a top surface of the parapet, and a short leg of the parapet bracket connected to the connecting plate and opposite to the long leg hangs vertically along an exterior surface of the parapet, the exterior surface being opposite to the interior surface of the parapet, and coupling the pipe to an external surface of the long leg of the parapet bracket, the external surface of the long leg facing away from the parapet.

In some embodiments, the method further includes adjusting the connecting plate to change a bracket spacing between the long and short leg based on a thickness of the parapet before hanging the parapet bracket on the parapet.

In some embodiments, the pipe is coupled to the external surface of the long leg using coupling holes on the long leg of the parapet bracket and also using a pipe hanger and fasteners. In some embodiments, the coupling holes are threaded and the fasteners are screws.

In some embodiments, the pipe is coupled to the external surface of the long leg using rectangular bores on the long leg of the parapet bracket and also using a metal zip tie.

In some embodiments, the connecting plate is a first connecting plate and the parapet bracket has a second connecting plate removably attached on top of the first connecting plate. In some embodiments, wherein the first connecting plate is directly attached to the long leg of the parapet bracket, and the second connecting plate is directly attached to the short leg of the parapet bracket.

Furthermore, a method of attaching a pipe to a parapet using a parapet bracket is disclosed that may include adjusting a bracket spacing between a long leg and a short leg of the parapet bracket by horizontally moving a first connecting plate attached to the long leg relative to a second connecting plate attached to the short leg, the bracket spacing being greater than or equal to a thickness of the parapet, hanging the parapet bracket on the parapet such that the long leg of the parapet bracket hangs vertically along an interior surface of the parapet facing a roof deck, the first and second connecting plates of the parapet bracket lay horizontally on a top surface of the parapet, and the short leg of the parapet bracket hangs vertically along an exterior surface of the parapet, the exterior surface being opposite to the interior surface of the parapet, and coupling the pipe to an external surface of the long leg of the parapet bracket using a plurality of coupling holes on a column of coupling holes on the long leg of the parapet bracket, the external surface of the long leg facing away from the parapet.

In some embodiments, the method further includes inserting a flexible membrane between the parapet bracket and the parapet.

In some embodiments, the first connecting plate has a first set of teeth structures along a length of the first connecting plate, and the second connecting plate has a second set of teeth structures along a length of the second connecting plate, the first and second set of teeth structures configured to engage each other after adjusting the bracket spacing to be greater than or equal to the thickness of the parapet. In some embodiments, the first connecting plate has a first plurality of fastening holes along the length of the first connecting plate, and the second connecting plate has a second plurality of fastening holes along the length of the second connecting plate. In some embodiments, the first and second connecting plates are fastened to each other using the first and second plurality of fastening holes after adjusting the bracket spacing between the long leg and the short leg of the parapet bracket.

In some embodiments, the plurality of coupling holes are threaded and screws are used to couple the pipe to the external surface of the long leg.

In some embodiments, a metal zip tie is used with the plurality of coupling holes to couple the pipe to the external surface of the long leg.

Additionally, a parapet bracket for hanging a pipe to a parapet of a roof is disclosed that may include a long leg having a column of coupling holes, the long leg configured to hang vertically along an interior surface of the parapet facing a roof deck of the roof, a first connecting plate orthogonally attached to the long leg and configured to lay horizontally on a top surface of the parapet, the first connecting plate having a first set of teeth structures extending along a length of the first connecting plate, a short leg being shorter than the long leg and configured to hang vertically along an exterior surface of the parapet that is opposite to the interior surface of the parapet, and a second connecting plate orthogonally attached to the short leg and configured to lay horizontally on the top surface of the parapet, the second connecting plate having a second set of teeth structures extending along a length of the second connecting plate, the second set of teeth structures configured to face the first set of teeth structures of the first connecting plate, wherein the first and second connecting plates are configured to move longitudinally relative to each other to define a bracket spacing between the long leg and the short leg, the bracket spacing being greater than or equal to a thickness of the parapet, wherein the first set of teeth structures are configured to engage the second set of teeth structures to keep the first and second connecting plates stationary relative to each other after creating the bracket spacing.

In some embodiments, the first connecting plate has a first plurality of fastening holes along the length of the first connecting plate, and the second connecting plate has a second plurality of fastening holes along the length of the second connecting plate. In some embodiments, the first and second connecting plates are configured to be fastened to each other using the first and second plurality of fastening holes to affix the first and second connecting plates to each other.

In some embodiments, the column of coupling holes has threaded coupling holes.

In some embodiments, the parapet bracket is made from stainless steel. In some embodiments, the long leg is welded to the first connecting plate and the short leg is welded to the second connecting plate.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
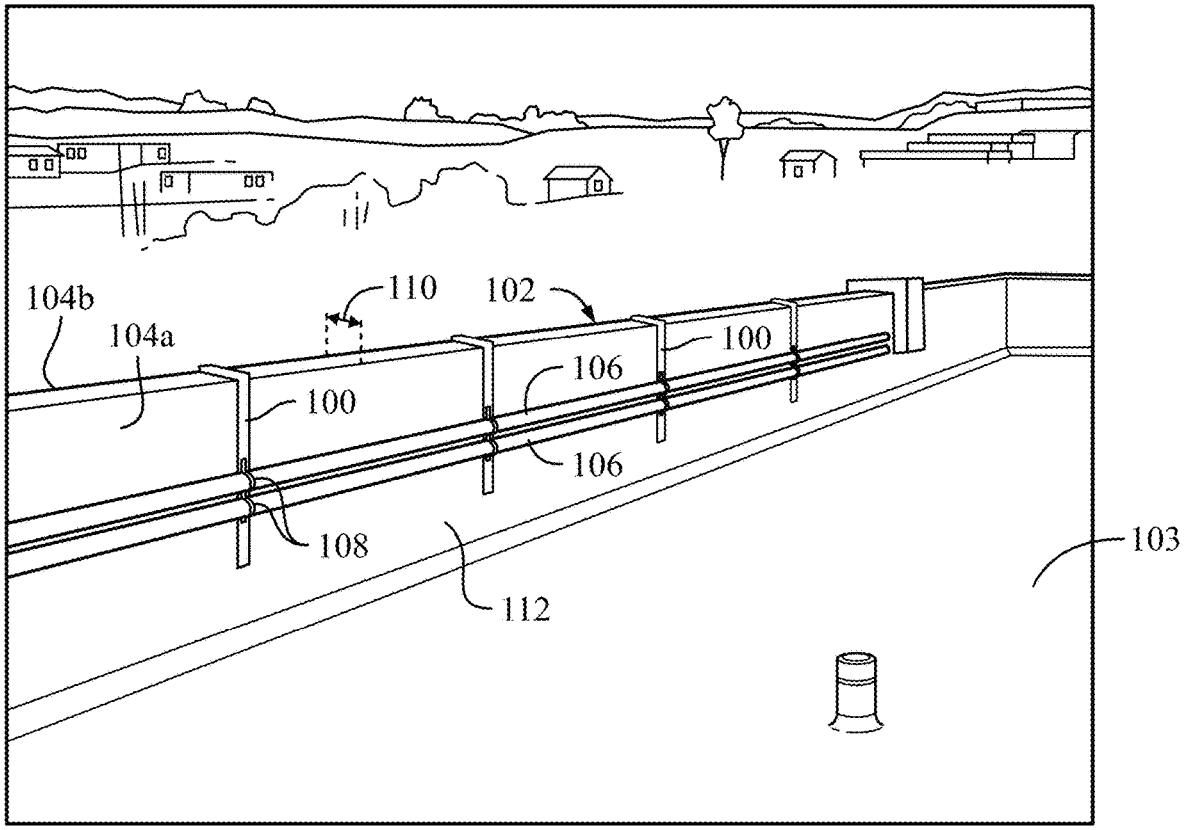
FIG. 1A shows mounting one or more pipes to the parapet wall using parapet brackets.
Figure 1B:
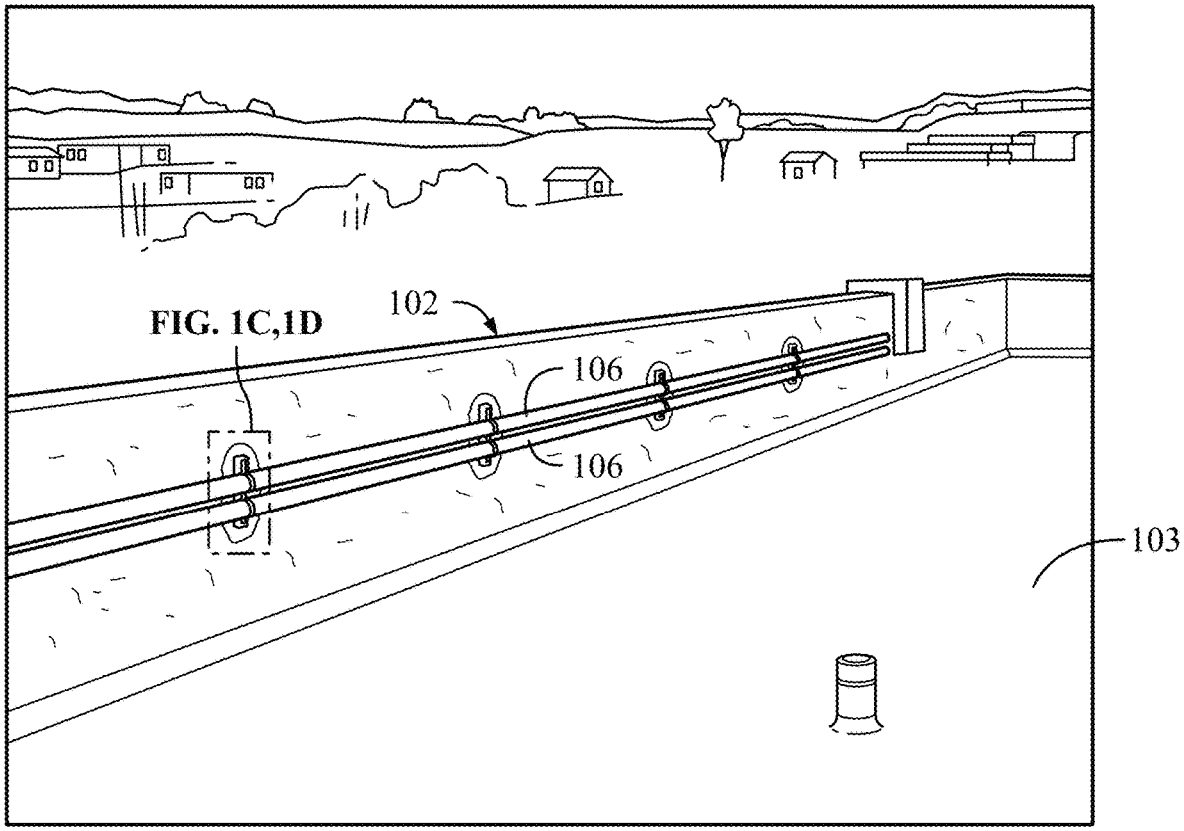
FIG. 1B (Prior Art)
FIG. 1B-D show mounting one or more pipes to the parapet wall using components and materials other than parapet brackets.
Figure 1C:
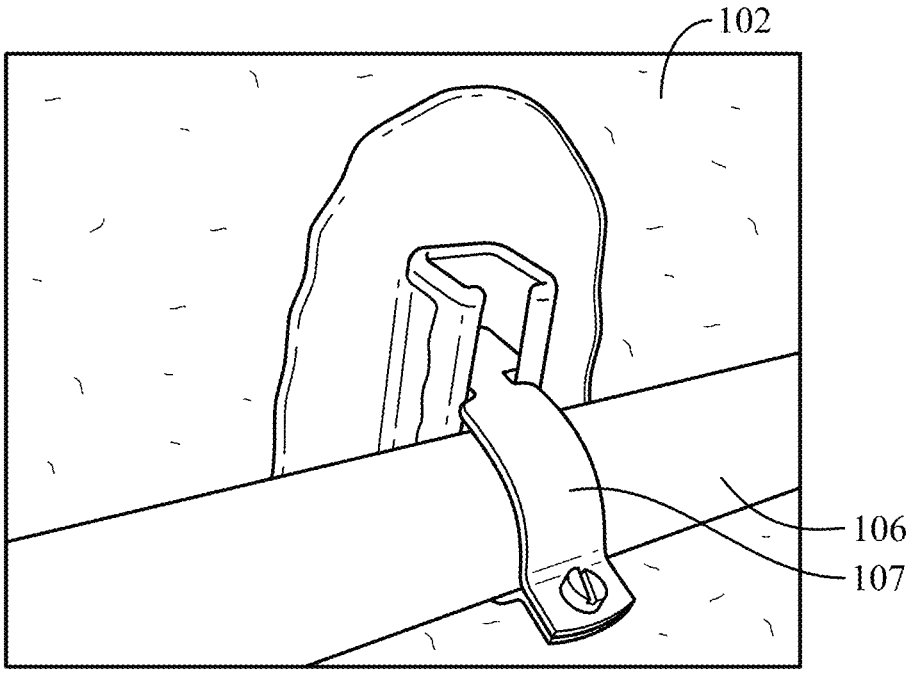
FIG. 1C (Prior Art)
Figure 1D:
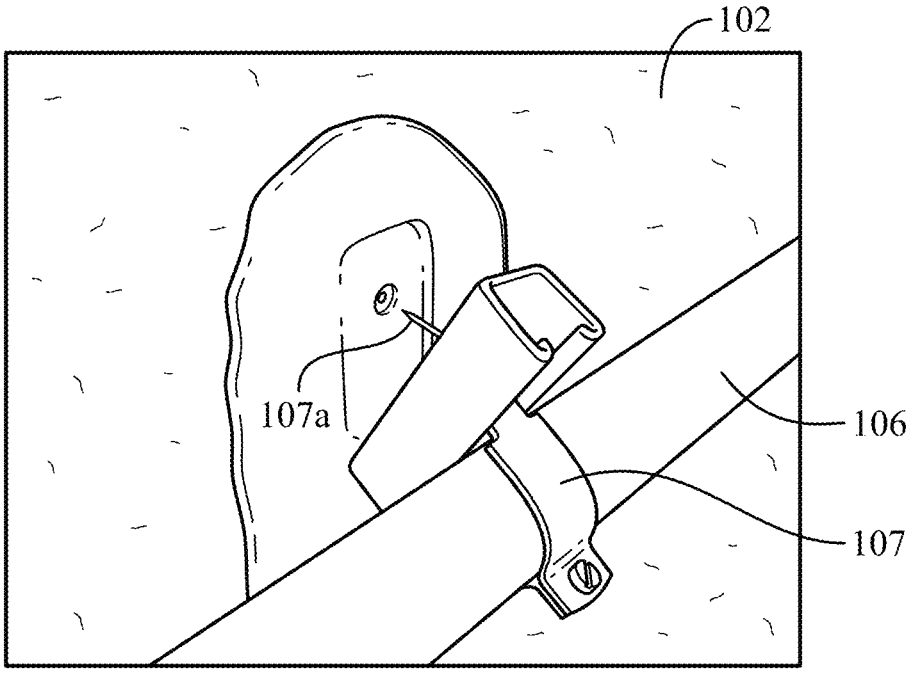
FIG. 1D (Prior Art)
Figure 2A:
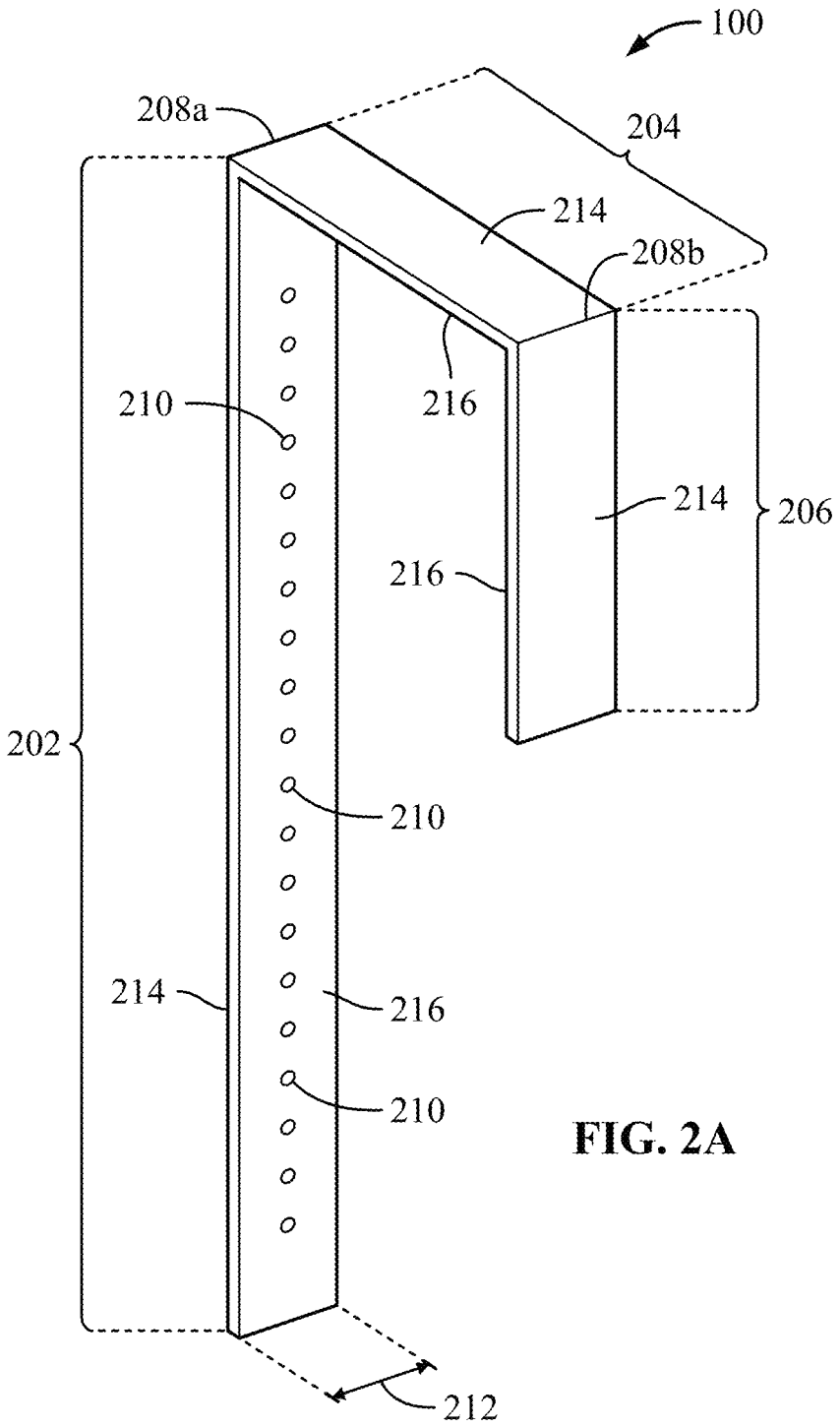
FIG. 2A shows a perspective view of the parapet bracket.
Figure 3A:
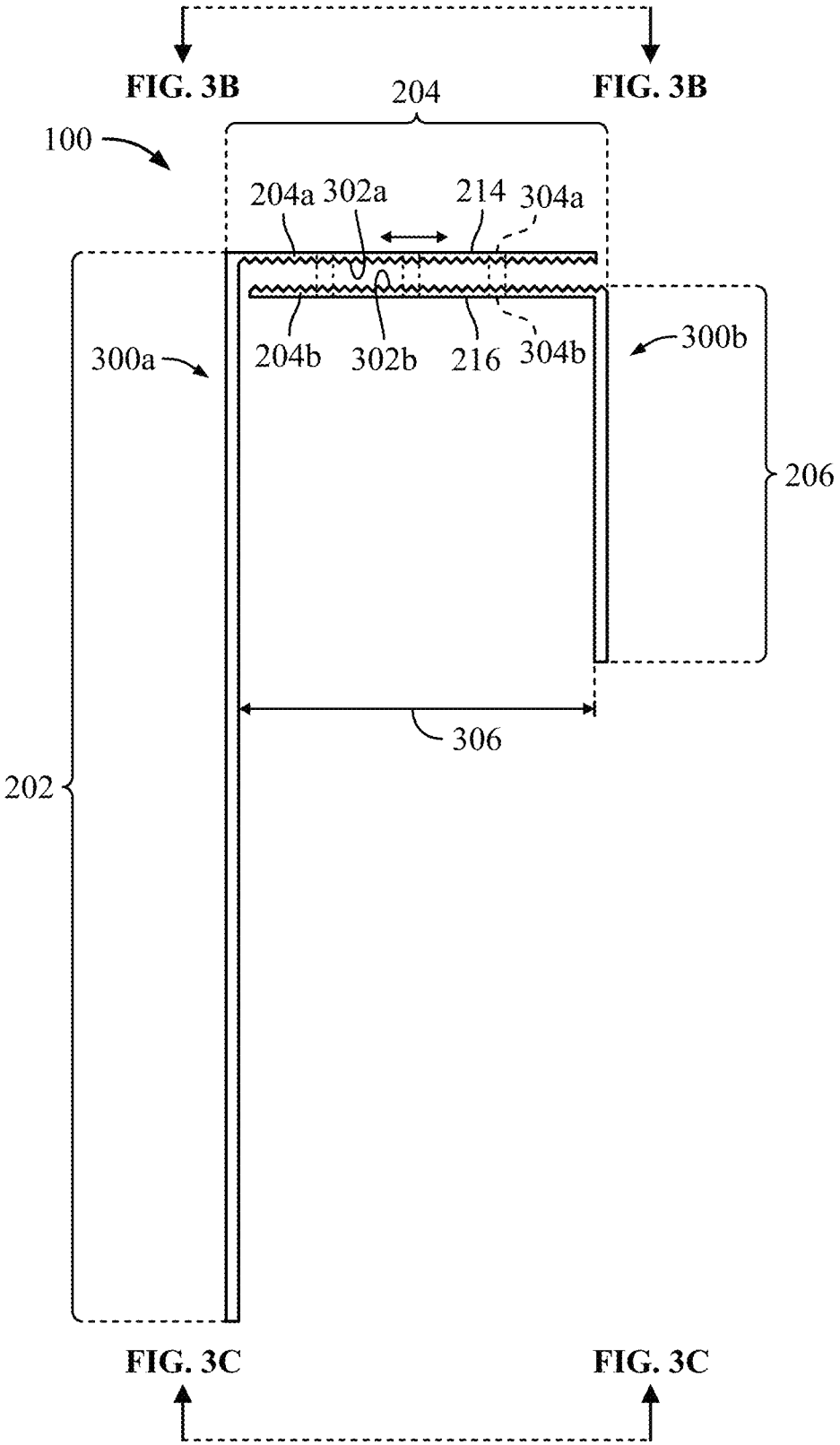
FIG. 3A shows a side-view of an adjustable parapet bracket.
Figure 5:
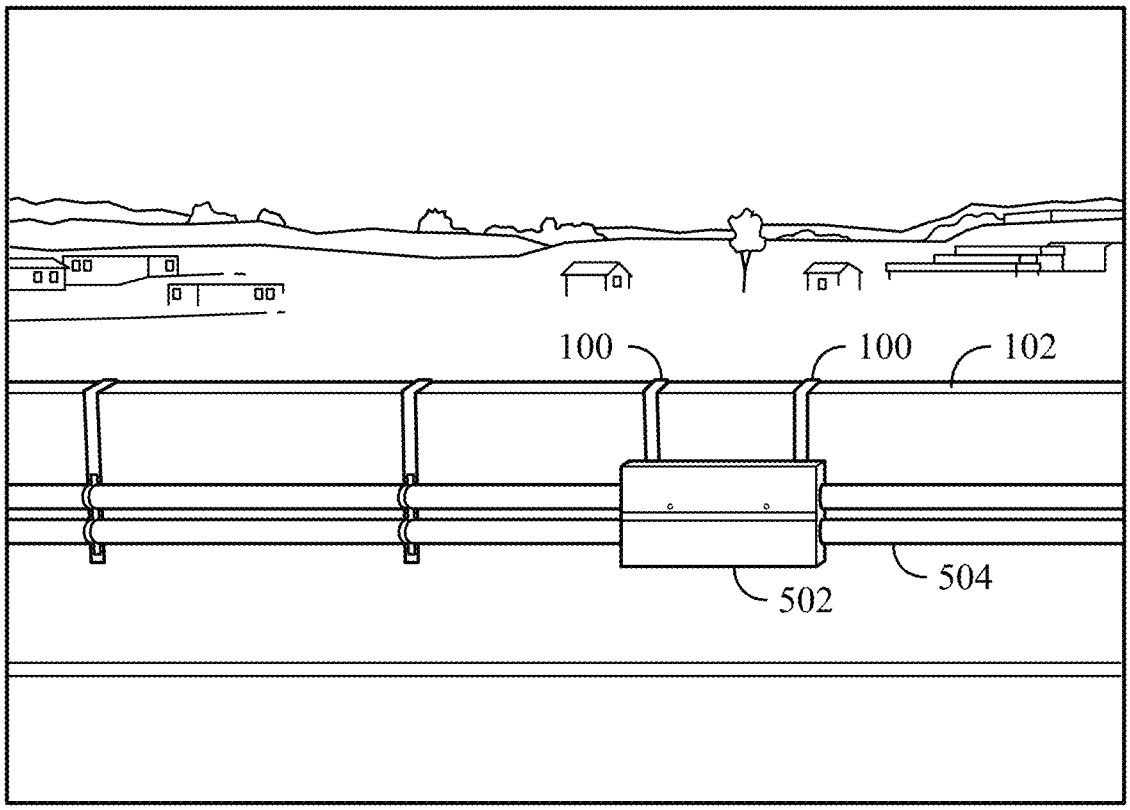
FIG. 5 shows an electric box being mounted to the parapet wall using parapet brackets.

Referring now to the figures, a parapet bracket 100 and a method of using thereof is disclosed. As shown in FIG. 1A, one or more parapet brackets 100 may be used to attach utility pipes 106 (e.g., gas, water, electric) to the parapet wall 102 without using fasteners directly on the parapet wall 102. There are no fasteners that penetrate the parapet wall. As shown in FIGS. 1B-D, using fasteners 107*a* to directly attach pipes 106 to the parapet wall 102 may result in damaging the wall and voiding the warranty of materials, such as weather-resistant coatings, used on the parapet wall 102. As shown in FIG. 2A, the parapet bracket 100 may have a short leg 206, long leg 202, and a connecting plate 204 between the short and long legs that form an inverted U-shape. The short leg 202 may be used to hook the parapet bracket 100 on the parapet wall 102, and the long leg may have a column of coupling holes 210 that may be used to couple pipes 106 to the parapet bracket 100. Consequently, the pipes 106 may be mounted to the parapet wall 102 indirectly and without having to pierce the parapet wall with fasteners, such as screws and nails. As shown in FIG. 3A, the connecting plate may come in two parts 204*a-b* such that a bracket spacing 306 between the long and short legs 202, 206 may be adjustable to match different thicknesses 110 (see FIG. 1A) of different parapet walls 102. As shown in FIG. 5, the parapet bracket 100 may also be used to mount other components, such as an electric box 502 with its electric conduits 504, to the parapet wall 102.

The rooftops of commercial, industrial, and even some residential buildings may have vertical parapet walls 102 surrounding horizontal roof decks 103. Conventionally, and as shown in FIG. 1B, utility pipes 106 (e.g., water, gas, electric) may directly be attached to the parapet 102, specifically to the interior surface 104*a* of the parapet 102 facing the roof deck 103. Such direct attachment may damage the parapet 102, especially over time, since pointy fasteners 107*a* (see FIG. 1D) are used, which pierce through the parapet 102 for the direct attachment of the pipes 106. As shown in FIG. 1D, using the fasteners 107*a* and hangers 107 to mount the pipes 106 directly to the parapet 102 may crack such wall and create a leakage point. This may be especially true when the pipes 106 need to be detached from the parapet 102 and the fasteners 107*a* are undone and pulled out of the parapet 102. Parapet wall flashings may tear or have a penetration in them, which can lead to roof leaks, rotted lumber, rotted decking and potential for mold over time. As shown in FIG. 1C, the conventional way to remedy the created piercing and crack in the parapet 102 may be by covering such region with a filler 105, for example tar, plaster, epoxy, or other adhesives.

Additionally, the direct attachment of pipes 106 to the parapet 102 may void the warranty of material used when constructing or renovating the parapet 102. By way of example, and as shown in FIG. 1A, the parapet 102 and the roof deck 103 may be covered by a roof coating 112 (e.g., silicone coating) that makes the roof weather-resistant or weather-proof. Such roof coating 112 may come with a factory warranty that may be void if fasteners 107*a* pierce through the layer of the coating 112 to directly attach the pipes 106 to the parapet 102.

To avoid the aforementioned problems created by directly fastening pipes 106 to the parapet 102, one or more parapet brackets 100 (see FIG. 1A) may be used to properly attach the pipes 106 and avoid piercing and cracking the parapet 102 and the roof coating 112. The parapet bracket 100 may hang on the parapet wall 102 and act as the medium where the pipes 106 may attach thereto. Instead of using fasteners to directly attach pipes 106 to the parapet 102, the fasteners may be used to attach the pipes 106 to the parapet bracket 100, which hangs on the parapet 102. The parapet bracket 100 does not need fasteners to hang on the parapet 102 and may be conveniently detached from such wall. The parapet bracket 100 may be configured to hold the weight of the pipes 106 and the fluids therein, which may be more than hundreds of pounds (e.g., greater than 100 pounds). The downward force of the weight of the pipes 106 may keep the parapet bracket 100 stationary and attached to the parapet 102 without the usage of fasteners.

Ultimately, mounting the one or more pipes 106 to the parapet bracket 100 that is hung on the parapet wall 102 may prevent damaging the parapet wall 102. The pipes 106 may be removed from the parapet bracket 100 without damaging the parapet 102. Also, the parapet bracket 100 may be removed from the parapet 102 without damaging such vertical wall. As described elsewhere herein, the parapet brackets 100 may also be used to mount other components, such as an electric box 502 shown in FIG. 5, to the parapet 102.

With reference to FIG. 2A, the parapet bracket 100 may have an inverted U-shape that may also be rectangular having connecting edges 208*a-b* between each bracket leg 202, 206 and the connecting plate 204. The parapet bracket 100 may have a long leg 202 and a short leg 206 that are configured to be vertical and connected to each other by a horizontal connecting plate 204. The long leg 202 may be connected (e.g., welded) orthogonally to the connecting plate 204 at a first connection edge 208*a* that is formed between the two parts. The short leg 206 may be connected orthogonally to the connecting plate 204, and in the same vertical orientation as the long leg 202, at a second connection edge 208*b* formed between the two parts. The second connection edge 208*b* may be on an opposite longitudinal end of the connecting plate 204 relative to the first connection edge 208*a*. Consequently, the bracket legs 202, 206 may be parallel to each other.

The short leg 206 may act as a hooking structure for the bracket 100 to latch and hang onto the parapet wall 102. The long leg 202 may have a column of coupling holes 210 that allow the pipes 106 to be fastened to the long leg 202. The connecting plate 204 may balance the bracket 100 on top of the parapet 102 and along the parapet thickness 110 (see FIG. 1A).

With further reference to FIG. 1A, the two bracket legs 202, 206 may hang on opposite sides 104*a-b* of the parapet 102 while the connecting plate 204 lays horizontally on a top surface of the parapet 102 and along the parapet thickness 110. The long leg 202 may hang on the interior surface 104*a* of the parapet 102 that is on the same side as the roof deck 103. The short leg 206 may be designed to hang on the exterior surface 104*b* of the parapet 102 that is on the opposite side of the roof deck 103. The short leg 206 may be shorter than the log 206 so that when hung on the exterior surface 104*b* of the parapet 102, the short leg 206 is less visible. As a result, a person looking from the exterior surface 104 side of the roof may not see the parapet bracket 100 and how the pipes 106 are mounted to the parapet 102. The connecting plate 204 of the bracket 100 may be between the long leg 202 and short leg 206 and lay horizontally on a top surface of the parapet 102 and along the thickness 110 of the parapet wall 102. The parapet thickness 110 may be defined by the distance between the interior and exterior surfaces 104*a-b* of the parapet 102.

The length 220 of the connecting plate 204 (see FIG. 2B) may be long enough to allow the bracket legs 202, 206 to slide down on the opposite surfaces 104*a-b* of the parapet 102. However, the length 220 of the connecting plate 204 may be short enough to eliminate unnecessary spacing between the opposing surfaces 104*a-b* of the parapet 102 and the bracket legs 202, 206. The length 220 of the connecting plate 204 may be such that the inner surfaces 216 of the long leg 202 and the short leg 206 contact the interior and exterior surfaces 104*a-b* of the parapet 102, respectively. Consequently, and by way of example, there may exist a snug fit between the parapet bracket 100 and the parapet wall 102, specifically between the legs 202, 206 of the bracket 100 and the opposite surfaces 104*a-b* of the parapet 102. As such, the parapet bracket 100 may be less likely to move and slide sideways due to the snug fit. Alternatively, there may exist a clearance fit between the parapet bracket 100 and parapet wall 102, specifically between the legs 202, 206 of the bracket 100 and the opposite surfaces 104*a-b* of the parapet 102. By way of example, there may exist a clearance in the range of 1/32 to 3/4 inches between the legs 202, 206 and the surfaces 104*a-b* of the parapet 102, which may mean that the length 220 of the connecting plate 204 may be greater than the parapet thickness 110 by 1/32 to 3/4 inches. In other examples, the clearance may be greater than 3/4 inches. The weight of the attached pipes 106 may still hold the bracket 100 in place and prevent movement, even with a clearance fit, since that pipes 106 may be heavy and weigh hundreds of pounds. As described elsewhere herein, the length 220 of the connecting plate 204 of the bracket 100 may be adjustable to create the correct spacing for different parapets 102 having different thicknesses 110.

Figure 4C:
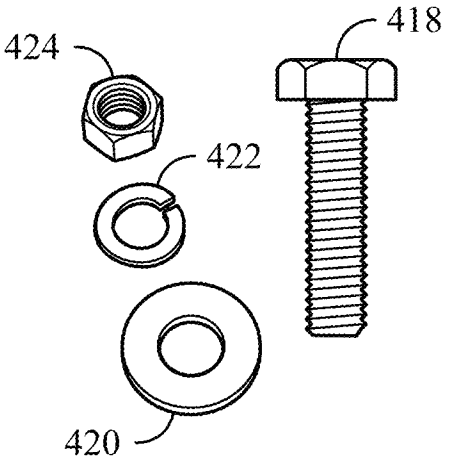
FIGS. 4A-C show different securing mechanisms that may be used to couple pipes to the parapet bracket.
Figure 4B:
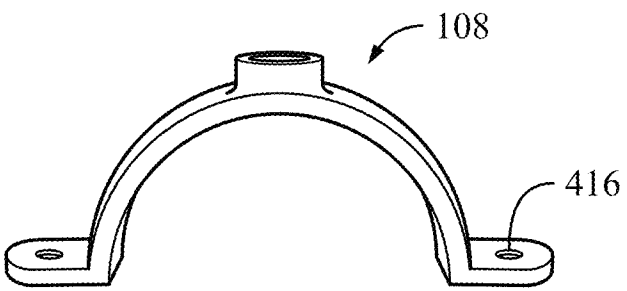

The utility pipes 106 may be mounted on the outer surface 214 of the parapet bracket 100 and specifically to the long leg 202. One or more hangers, fasteners, and straps may be used to mount a pipe 106 to the long leg 202 of the parapet bracket 100. By way of example and not limitation, the long leg 202 may have a column of coupling holes 210 extending vertically along the long leg 202. As a result, the vertical positioning of the pipe 106 along the long leg 202 may be adjustable. By way of example and not limitation, the pipe 106 may be enclosed on the outer surface 214 of the long leg 202 by a pipe hanger 108 (see FIG. 1A) at a vertical position on the long leg 202 determined by a user. As shown in FIG. 4B, the pipe hanger 108 may have fastening holes 416 that align with corresponding coupling holes 210 on the long leg 202. Fasteners may be inserted in the fastening holes 416 and coupling holes 210 to affix the pipe hanger 108 and the pipe 106 held therewithin to the long leg 202 of the parapet bracket 100. By way of example and not limitation, the coupling holes 210 may be threaded such that screws 418 (see FIG. 4C) may be used to affix the pipe hanger 108 and the pipe 106 to the long leg 202. By way of example, lock washers 422 and flat washers 420 may be used in fastening the pipe hanger 108 and the pipe 106 to the long leg 202 and ensure a better fastening between the parts. Alternatively, the coupling holes 210 may not be threaded and a bolt and a nut 424 may be used as the fastening components.

Figure 2B:
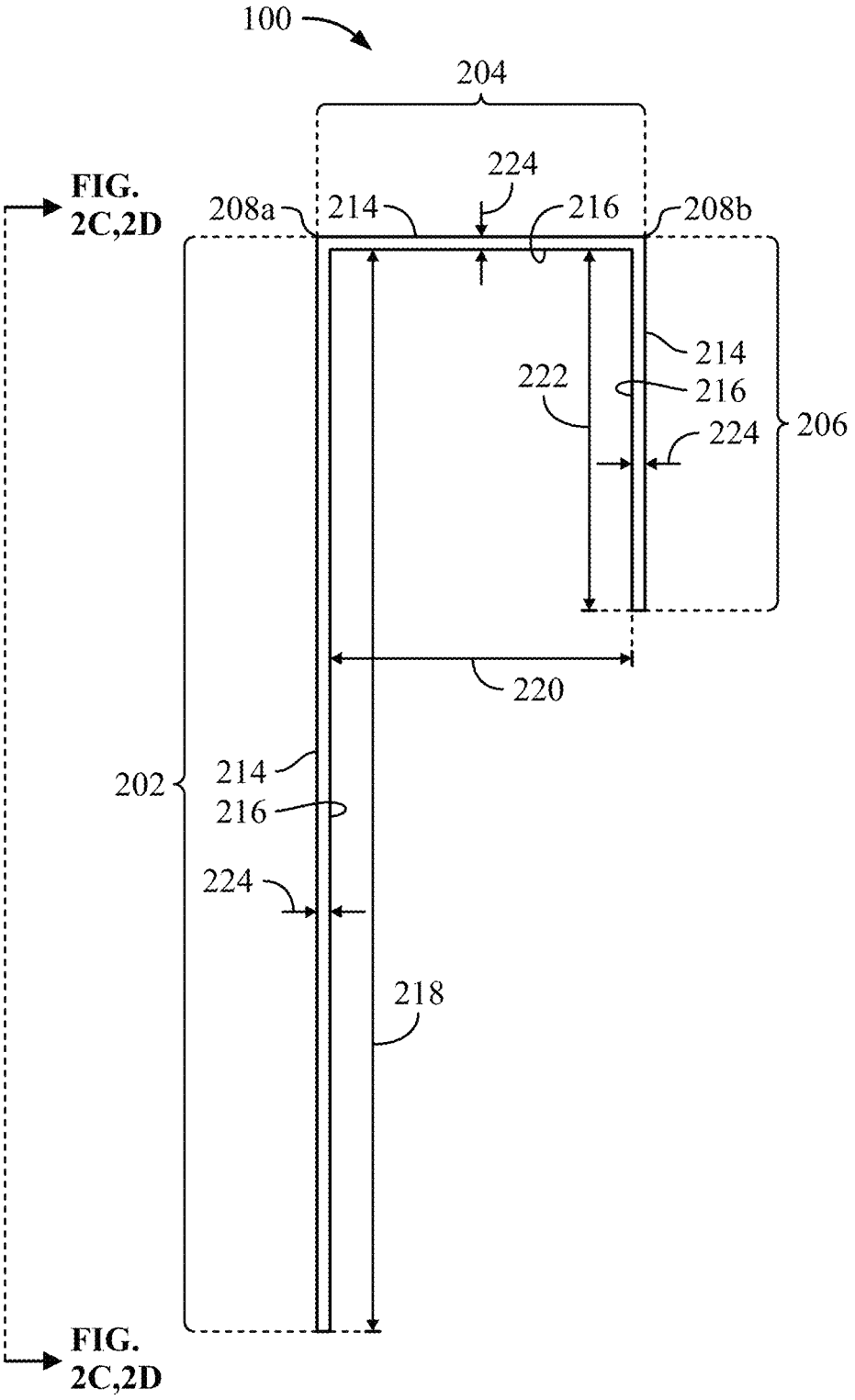
FIG. 2B shows a side-view of the parapet bracket of FIG. 2A.
Figure 2C:
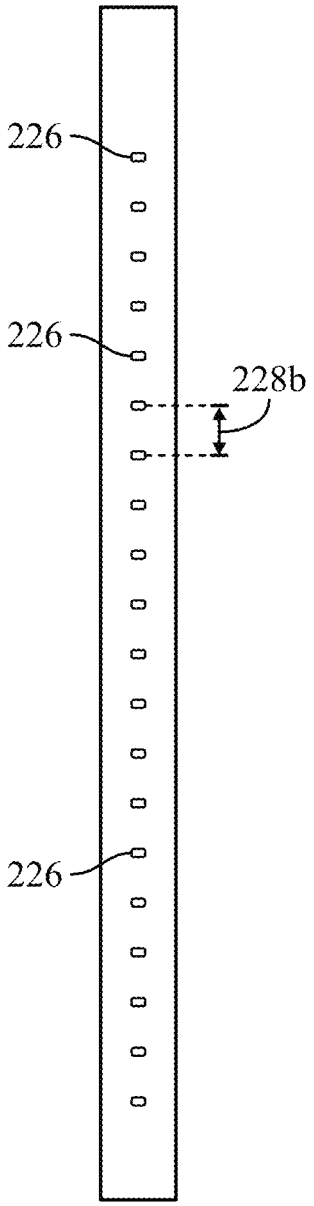
FIG. 2C-D show rear-views of the parapet bracket of FIG. 2B having different types of holes.
Figure 4A:
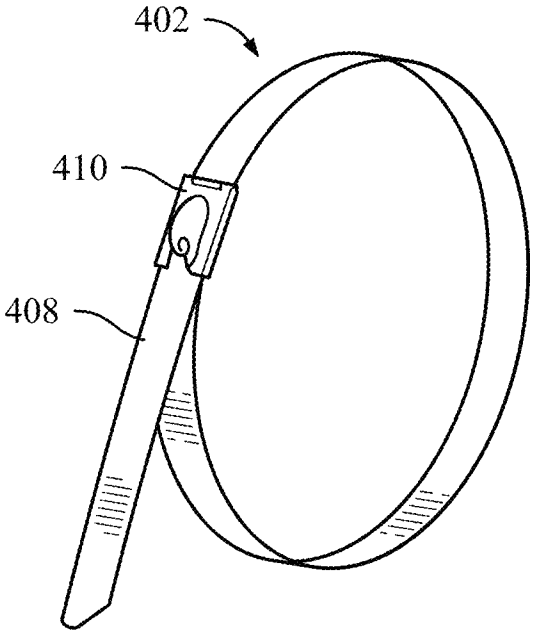

In another example, and as shown in FIG. 2C, the column of coupling holes 210 may be substituted by a column of rectangular bores 226, and a metal zip tie 402 (see FIG. 4A) may affix the pipe 106 onto the outer surface 214 of the long leg 202. The metal zip tie 402 may tie the pipe 106 to the long leg 202 of the bracket 100 by going through two rectangular bores 226 that the pipe 106 is therebetween and wrapping around the pipe 106. The metal strip 408 of the zip tie 402 may tighten around the pipe 106, and the locking head 410 of the zip tie 402 may prevent the loosening of the metal strip 408 around the pipe 106.

Figure 4D:
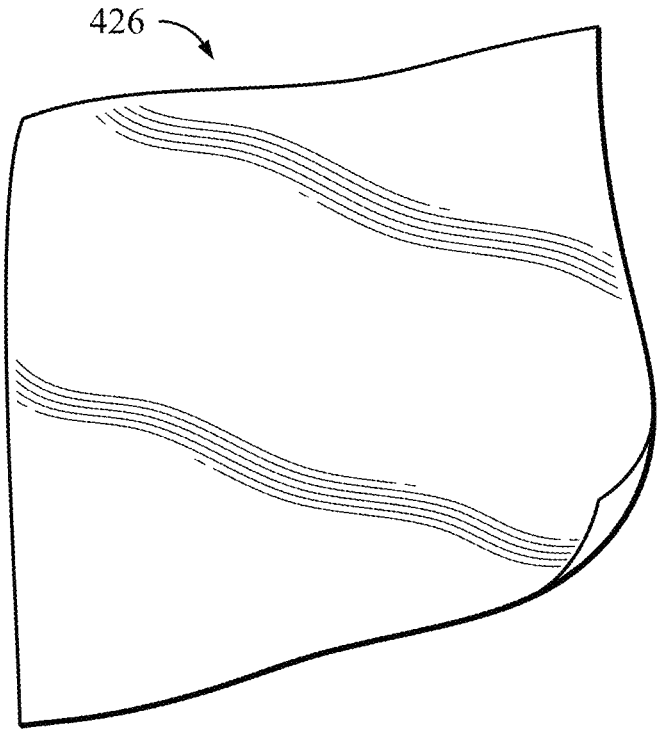
FIG. 4D shows a flexible membrane that may be used between the parapet wall and the parapet bracket.

In some examples, a flexible membrane 426 (see FIG. 4D) may be placed between the parapet 102 and the inner surface 216 of the parapet bracket 100 before mounting the pipe 106 to the bracket. The flexible membrane 426 may be placed between the parapet 102 and one or more of the inner surfaces 216 of the of the short leg 206, connecting plate 204, and long leg 202. The flexible membrane 426 may be a roofing membrane having a greater flexibility and elasticity relative to the material that the outer surface of the parapet is made from (e.g., solid concrete) and also more flexible and elastic than the material that the parapet bracket 100 is made from (e.g., metal alloy). The flexible membrane 426 may absorb vibration and reduce movement of the parapet bracket 100. Also, the flexible membrane 426 may better distribute the weight of the parapet bracket 100 and the pipes 106 mounted thereto due to the flexibility of the membrane. The flexible membrane 426 may also mitigate any scratches that the parapet bracket 100 may do to the parapet 102.

Referring now to FIG. 3A, an adjustment mechanism is shown that allows for the bracket spacing 306 between the long leg 202 and the short leg 206 to be adjusted. The bracket spacing 306 may be the same as the length 220 of the connecting plate 204 (see FIG. 2B) since such length determines the spacing for receiving the parapet 102 and for the parapet bracket 100 to hang along the thickness 110 of the parapet. Different rooftops may have parapets 102 with different parapet thicknesses 110, shown in FIG. 1A. Consequently, the parapet bracket 100 may be adjustable to fit parapets 102 with different thicknesses 110 and to add versatility to the device.

As shown in FIG. 3A, the parapet bracket 100 may come in two parts 300*a-b*. The first part 300*a* of the parapet bracket 100 may have the long leg 202 attached to a first connecting plate 204*a*. The second part 300*b* of the parapet bracket 100 may have the short leg 206 attached to a second connecting plate 204*b*. In other words, the connecting plate 204 shown in FIG. 2A may be split lengthwise into upper and lower portions 204*a-b*, which also splits the thickness of such connecting plate 204. By way of example and not limitation, the top connecting plate 204*a* may be attached to the long leg 202 at the first connection edge 208*a* (see FIG. 2A), described elsewhere herein. By way of example and not limitation, the bottom connecting plate 204*b* may be attached to the short leg 206 at the second connection edge 208*b*, described elsewhere herein. Alternatively, the top connecting plate 204*a* may be attached to the short leg 206 and the bottom connecting plate 204*b* may be attached to the long leg 202.

The bottom side of the top connecting plate 204*a* may have adjustment teeth 302*a*, and the top side of the bottom connecting plate 204*b* may have corresponding adjustment teeth 302*b*. The adjustment teeth 302*a* and the corresponding adjustment teeth 302*b* may be configured to engage each other and interlock the first and second parts 300*a-b* of the parapet bracket 100. The two sets of adjustment teeth 302*a-b* may zigzag along the lengths of the top and bottom connecting plates 204*a-b*, respectively. By way of example and not limitation, the adjustment teeth 302*a-b* of the of the top and bottom connecting plates 204*a-b* may be gear teeth similar to a gear rack. The two sets of adjustment teeth 302*a-b* may prevent the top and bottom connecting plates 204*a-b* to slide lengthwise against each other once the bracket spacing 306 is adjusted to the desired length.

Figure 3B:
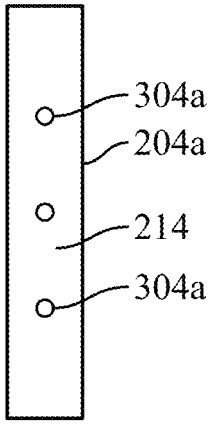
FIGS. 3B-C show top and bottom views of the adjustable parapet bracket of FIG. 3A.
Figure 3C:
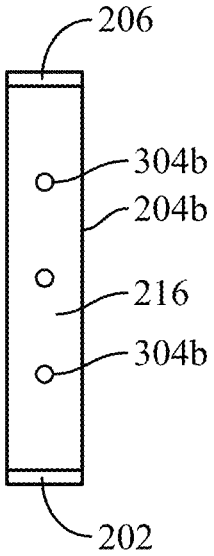

The top connecting plate 204*a* may have a plurality of adjustment holes 304*a* extending through its thickness, and the adjustment holes 304*a* may be symmetrically distributed along the length of the top connecting plate 204*a*. Also, the bottom connecting plate 204*b* may have a plurality of corresponding adjustment holes 304*b* extending through its thickness, and the corresponding adjustment holes 304*b* may be symmetrically distributed along the length of the bottom connecting plate 204*b*. The adjustment holes 304*a-b* may be used to affix and clamp down the first and second parts 300*a-b* of the parapet bracket 100 when the bracket spacing 306 is widened or narrowed to the desired length. As such, the first and second parts 300*a-b* of the parapet bracket 100 may not slide sideways apart from each other. By way of example and not limitation, the two sets of adjustment holes 304*a-b* may be threaded such that one or more screws may be used to fasten the top and bottom connecting plates 204*a-b* together. By way of example and not limitation, bolts and nuts may be used to fasten the top and bottom connecting plates 204*a-b* together using the two sets of adjustment holes 304*a-b* thereon, respectively. FIGS. 3B-C, show the top and bottom view of the two-part 300*a-b* parapet bracket 100 and how the two sets of adjustment holes 304*a-b* align with each other. By way of example and not limitation, each connecting plate 204*a-b* may have between two to 10 adjustment holes 304*a-b*.

To adjust the bracket spacing 306 of FIG. 3A, the top and bottom connecting plates 204*a-b* may first vertically be separated from each other. The top and bottom connecting plates 204*a-b* may then move relative to each other along their lengths to increase or decrease the bracket spacing 306. When the desired bracket spacing 306 is achieved, the top and bottom connecting plates 204*a-b* may lay on top of each other such that the two sets of adjusting teeth 302*a-b* engage each other. The top and bottom connecting plates 204*a-b* may then be secured to each other using fasteners with the adjustment holes 304*a-b* aligned with each other. By way of example and not limitation, the bracket spacing 306 may be adjusted to have a length between six and 12 inches since parapets 102 usually have thicknesses 110 (see FIG. 1A) of such range. In other examples, the bracket spacing 306 may be adjusted to have a length greater than 12 inches or less than six inches.

Figure 2D:
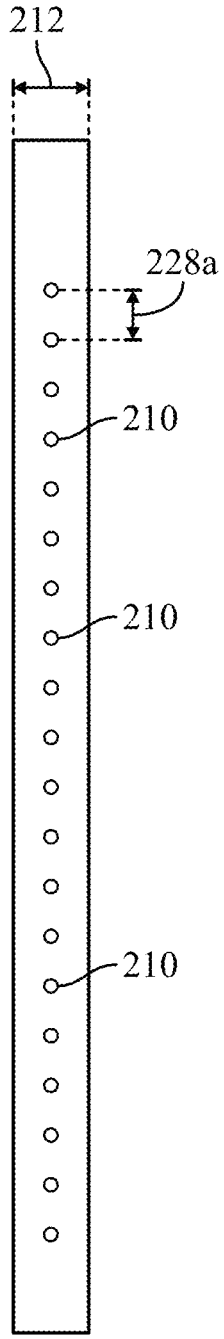

The dimensions of the different components of the parapet bracket 100 will now be discussed. By way of example and not limitation, the long leg 202 of the parapet bracket 100 may have a height 218 (see FIG. 2B) between four and 30 inches. In some examples, the height 218 of the long leg 202 may be greater than 30 inches. The height 218 of the long leg 202 may be defined as the distance between the first connection edge 208*a* (see FIG. 2A) and the bottom edge of the long leg 202. The longer the height 218 of the long leg 202, the more coupling holes 210 may be added to increase adjustment range for attaching pipes 106 (see FIG. 1A). Also, and in some examples, the long leg 202 may touch the roof deck 103 when having a long height 218 (e.g., greater than 30 inches) to create stability and foundation for the parapet bracket 100. The shorter the height 218 of the long leg 202 (e.g., less than eight inches), the parapet bracket 100 may be more compact and lightweight. By way of example and not limitation, and as shown in FIGS. 2C-D, the vertical spacing 228*a* between adjacent coupling holes 210, or the vertical spacing 228*b* between adjacent rectangular bores 226, may be between 0.75 to 3.0 inches. The vertical spacing 228*a-b* of the holes and bores may be of importance to accommodate differently sized pipes 106 to be attached to the long leg 202 of the bracket 100.

By way of example and not limitation, the short leg 206 of the parapet bracket 100 may have a height 222 (see FIG. 2B) between 1.5 and 12 inches. In some examples, the height 222 of the short leg 206 may be greater than 12 inches. The height 222 of the short leg 206 may be defined as the distance between the second connection edge 208*b* (see FIG. 2A) and the bottom edge of the short leg 206. The longer the height 222 of the short leg 206 (e.g., greater than seven inches), the more clasping support such leg may provide to the parapet bracket 100 while hanging on the parapet 102. The shorter the height 222 of the short leg 206 (e.g., less than three inches), the easier the short leg 206 may hook to the exterior surface 104*b* (see FIG. 1A) of the parapet 100, and the less visible the parapet bracket 100 will be from the exterior surface 104*b* of the parapet 102.

As shown in FIG. 2B, the long leg 202, the connecting plate 204, and the short leg 202 may have bracket thicknesses 224 defined by the distance between the outer surface 214 (see FIG. 2A) and inner surface 216 of the such components. By way of example and not limitation, the bracket thickness 224 may range between 1/16 to 3/8 inches. In some examples, the bracket thickness 224 may be greater than 3/8 inches. In some examples, the thickness of connecting plate 204 may be different (e.g., greater or less than) the thickness of the long and short legs 202, 206. The greater the thickness 224, the more likely the parapet bracket 100 may support heavier pipes 106. The lesser the thickness 224, the more lightweight the parapet bracket 100 may be for ease of attachment and installation.

As shown in FIG. 2A, the parapet bracket 100 may have a width 212 defined by the lateral distance between the longitudinal edges of the long leg 202, connecting plate 204, and short leg 206 that are connected to each other and may have the same width 212. By way of example and not limitation, the parapet bracket 100 may have a bracket width 212 between 0.75 to two inches. The wider width may be preferred for making the parapet bracket 100 handle more weight of the pipes 106. The narrow width may be preferred for making the parapet bracket 100 lightweight and compact.

As shown in FIG. 2B, the length 220 of the connecting plate 204 may be defined as the horizontal distance between the inner surface 216 of the long leg 202 and the inner surface 216 of the short leg 206. The length 220 of the connecting plate 204 may be slightly greater than the thickness 110 (see FIG. 1A) of the parapet 102 to create a snug or clearance fit, as described elsewhere herein. By way of example and not limitation, the length 220 of the connecting plate 204 may be between six and 12 inches since the thickness 110 of the parapet 102 may have a similar range. In other examples, the length 220 of the connecting plate 204 may be greater than 12 inches or less than six inches. The length 220 of the connecting plate 204 may be adjustable, as described elsewhere herein. Consequently, the length 220 of the connecting plate 204 may be adjusted to a different dimension that is described elsewhere herein.

By way of example and not limitation, the long leg 202, connecting plate 204, and short leg 206 may each be separate metal plates that are welded together. The long leg 202 and the connecting plate 204 may be welded together orthogonally at the first connection edge 208*a* to form an L-shape together. The short leg 206 and the connecting plate 204 may be welded together orthogonally at the second connection edge 208*b* to form a second L-shape together. The two L-shapes may be in the same direction to form the inverted U-shape, where the short leg 206 is shorter than the long leg 202. Welding metal plates to form the parapet bracket 100 may allow for using stronger and sturdier material. By way of example and not limitation, the parapet bracket 100 and its components may be made from stainless steel. In other examples, the parapet bracket 100 and its components may be made from other steel alloys.

Alternatively, a long metal strip may be bent to create the inverted U-shape of the parapet bracket 100. A long strip of metal may be bent twice orthogonally towards each other to create the first and second connection edges 208*a-b*. The long leg 202, connecting plate 204, and short leg 206 may also be defined by such two orthogonal bending. By way of example and not limitation, the parapet bracket 100 and its components may be made from mild steel or aluminum alloy. In other examples, the parapet bracket may be made from a rigid polymer material and may also be manufactured using a 3D printer.

Figure 6:
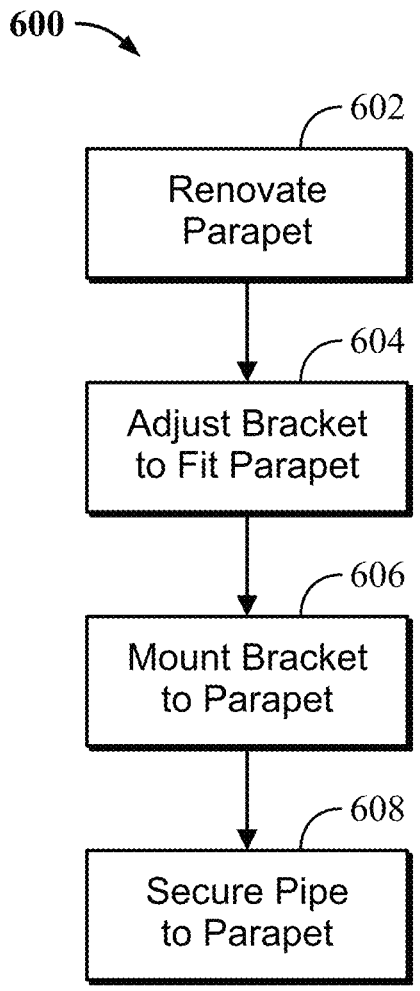
FIG. 6 shows a method for using the parapet bracket.

Referring now to FIG. 6, a method 600 of using the parapet bracket 100 for installing pipes 106 (see FIG. 1A) to the parapet wall 102 is disclosed. The method 600 may include renovating 602 or constructing the parapet wall 102, adjusting the parapet bracket 100 to fit the parapet 102, mounting the parapet bracket 100 to the parapet 102, and securing pipes 106 to the parapet bracket 100. The method 600 may also be used to mount other components, such as an electric box 502 (see FIG. 5), to the parapet wall 102 as well.

In block 602, the method 600 renovates the parapet wall 102 that the mounting bracket 100 will be attached thereto. The method 600 may renovate the parapet wall 102 since there may exist cracks and holes in such wall that may have been caused by the improper mounting of pipes 106 to the parapet 102, as described elsewhere herein and shown in FIGS. 1B-D. The method 600 may also renovate the roof deck 103 (see FIGS. 1*a*-B) although the renovation of the parapet 102 will be focused herein. The pipes 106 (see FIGS. 1A-D) may either be removed from the parapet 102 to be reattached on the parapet bracket 100, or the pipes 106 may be removed and replaced by new pipes 106 that are attached to the parapet bracket 100. The pipes 106 may be set down on place holders (e.g., a bucket or a box on the ground) next to the parapet 102 to reattach the removed pipes 106 after renovating. During the renovation of the parapet wall 102, any old coating (e.g., weather-resistant coating or paint) may be removed and the parapet wall 102 may be cleaned by spray washing. The spray washing may clean dust, dirt, and other unwanted material from the parapet 102 to properly applying a new coating 112 (see FIG. 1A) to the parapet 102.

After cleaning the parapet 102, a coating layer 112 (see FIG. 1A) may be applied to the parapet 102. By way of example and not limitation, the coating layer 112 may be a weather-resistant/proof layer, a water-resistant/proof layer, an ultra-violet protective layer, a paint layer, or a combination thereof. By way of example and not limitation, the coating layer 112 may have a factory warranty that may be void if such coating is pierced through by screwing fasteners therein and to the parapet wall 102. By way of example and not limitation, the coating layer 112 may be silicone coating.

In other example, block 602 may pertain to constructing new parapet walls 102 instead of renovating old ones. The pipes 106 may still need to be attached to the newly constructed parapets 102 using the parapet brackets 100 to ensure no cracks are created in the walls. The material used for construction of the parapet 102, including coating layer 112, may also have factory warranty. During construction of new parapet 102, the structure may still need to be cleaned and spray washed to apply the coating layer 112.

In block 604, the method 600 adjusts the parapet bracket 100 to fit the parapet wall 102. Block 604 may only apply to parapet brackets 100 that have adjustable bracket spacing 306 (see FIG. 3A), described elsewhere herein. The adjusting of the bracket spacing 306 may be done, for example, by the structural components shown in FIG. 3A, FIGS. 8A-B, FIGS. 9A-B, or FIGS. 10A-B. In other examples, the parapet bracket 100 may not have adjusting mechanisms and may be designed to fit a parapet 102 having a specific thickness 110 (e.g., six, eight, or twelve inches).

In block 604, the connecting plate 204*a* attached to the long leg 202 may be traversed lengthwise relative to the connecting plate 204*b* attached to the short leg 206 to narrow or widen the bracket spacing 306. The bracket spacing 306 may be narrowed and widened based on how thick the parapet thickness 110 (see FIG. 1A) is such that the parapet bracket 100 may hang on the parapet 102. The bracket spacing 306 may be wide enough such that the parapet bracket 100 may hang on the parapet 102 but narrow enough to minimize unwanted movement between the bracket and the parapet.

By way of example and not limitation, bracket spacing 306 may be adjusted to have a length between six and 12 inches to fit the size of the parapet thickness 110. In other examples, the bracket spacing 306 may be adjusted to have a length greater than 12 inches or less than six inches. By way of example and not limitation, the bracket spacing 306 may be adjusted such that there exists a snug fit or clearance fit between the opposing surfaces 104*a-b* of the parapet 102 and the inner surfaces 216 of the long and short legs 202, 206 of the parapet bracket 100. By way of example, there may exist a clearance in the range of 1/32 to ¾ inches between the legs 202, 206 and the surfaces 104*a-b* of the parapet 102, which may mean that the bracket spacing 306 of the connecting plate 204 may be greater than the parapet thickness 110 by 1/32 to ¾ inches. In other examples, the clearance may be greater than ¾ inches. After the bracket spacing 306 is adjusted based on parapet thickness 110, the connecting plate 204*a* of the long leg 202 may be secured to the connecting plate 204*b* of the short leg 206 so that the two separate parts 300*a-b* of the parapet bracket 100 are affixed to each other and the bracket spacing 306 does not change.

In block 606, the method 600 mounts the parapet bracket 100 to the parapet wall 102. The parapet bracket 100 may be hang on the parapet 102 such that the inner surface 216 of the connecting plate 204 is placed on a top surface of the parapet 102 and horizontally along the parapet thickness 110. The inner surface 216 of the long leg 202 may touch and lay vertically on the interior surface 104*a* of the parapet 102, where the long leg 202 provides a column of coupling holes 210 to attach pipes 106 thereon. The inner surface 216 of the short leg 206 may touch and lay vertically on the exterior surface 104*b* of the parapet 102, where the short leg 206 may act as a hooking mechanism that keeps the parapet bracket 100 attached to the parapet. In the mounted position, the parapet bracket 100 may remain static and fixed in place relative to the parapet 102. However, the parapet bracket 100 may be conveniently removable from the parapet 102 since no fasteners are used to affix the parapet bracket 100 to the parapet wall 102. As described elsewhere herein, the weight of the pipes 106 that may be attached to the parapet bracket 100 may help keep the bracket 100 static relative to the parapet 102.

When mounting the parapet bracket 100 on the parapet wall 102, a flexible membrane 426 (see FIG. 4D) may be placed between the bracket and the vertical wall. The flexible membrane 426 may be as described elsewhere herein. The flexible membrane 426 may be placed between the parapet 102 and one or more of the inner surfaces 216 of the of the short leg 206, connecting plate 204, and long leg 202. The flexible membrane 426 may be a roofing membrane and has a greater flexibility and elasticity relative to the material that the outer surface of the parapet is made from (e.g., solid concrete) and also more flexible and elastic than the material that the parapet bracket 100 is made from (e.g., metal alloy). The flexible membrane 426 may absorb vibration and reduce movement of the parapet bracket 100. Also, the flexible membrane 426 may better distribute the weight of the parapet bracket 100 and the pipes 106 mounted thereto due to the flexibility of the membrane. The flexible membrane 426 may also mitigate any scratches that the parapet bracket 100 may do to the parapet 102.

In block 608, the method 600 secures the pipes 106 to the parapet bracket 100. By way of example and not limitation, the side of a pipe 106 may be placed between two coupling holes 210 and at a desired height on the long leg 202 of the parapet bracket 100. The side of the pipe 106 on the long leg 202 may be enclosed on the leg using a pipe hanger 108 (see FIG. 1A). The pipe 106 may then be fastened to the long leg 202 by using fasteners (e.g., screws 418) to fix the pipe hanger 108 having the pipe 106 therebetween to the bracket using the coupling holes 210 being aligned with the fastening holes 416 (see FIG. 4B) of the pipe hanger 108. By way of example and not limitation, the coupling holes 210 on the long leg 202 may be threaded to receive screws 418. By way of example and not limitation, one or more lock washers 422 and flat washers 420 may be used in conjunction with the screws 418 to better fasten the pipe 106 to the long leg 202 of the bracket 100. Alternatively, bolts and nuts 424 may be used as the fastening parts for affixing the pipe 106 to the parapet bracket 100 using the pipe hanger 108.

Alternatively, the pipe 106 may be mounted to the parapet bracket 100 using a metal zip tie 402 and two rectangular bores 226 on the long leg 202 of the bracket, as described elsewhere herein. The side of the pipe 106 may be placed between two rectangular bores 226 at a desired height on the long leg 202 of the bracket 100. The metal strip 408 of the metal zip tie 402 may be wrapped around the pipe 106, inserted in the two rectangular bores 226, and tightened to hold the pipe 106 in place at the desired height. The tightened metal strip 408 may be locked into place using the locking head 410 of the zip tie 402.

The weight of the pipe 106, which may be hundreds of pounds, may keep the parapet bracket 100 stationary and affixed to the parapet 102 since such downward force is being applied on the bracket. However, the parapet bracket 100 may conveniently be detached from the parapet 102 when the pipes 106 are detached from the parapet bracket 100 since no fasteners or securing means is used to affix the bracket to the parapet wall. As shown in FIG. 1A, more than one pipe 106 may be mounted to the parapet bracket 100. A desired height for the second or third pipe 106 may be determined on the long leg 202 of the parapet and the same steps described elsewhere herein may be applied again for those pipes. Additionally, other components that are not pipes 106, such as an electric box 502 (see FIG. 5), may be mounted to the parapet 102 using one or more parapet brackets 100. As shown in FIG. 5, two parapet brackets 100 may be used, similar to what has been described with attaching pipes 106, to mount an electric box 502 to the parapet wall 102.

Figure 7A:
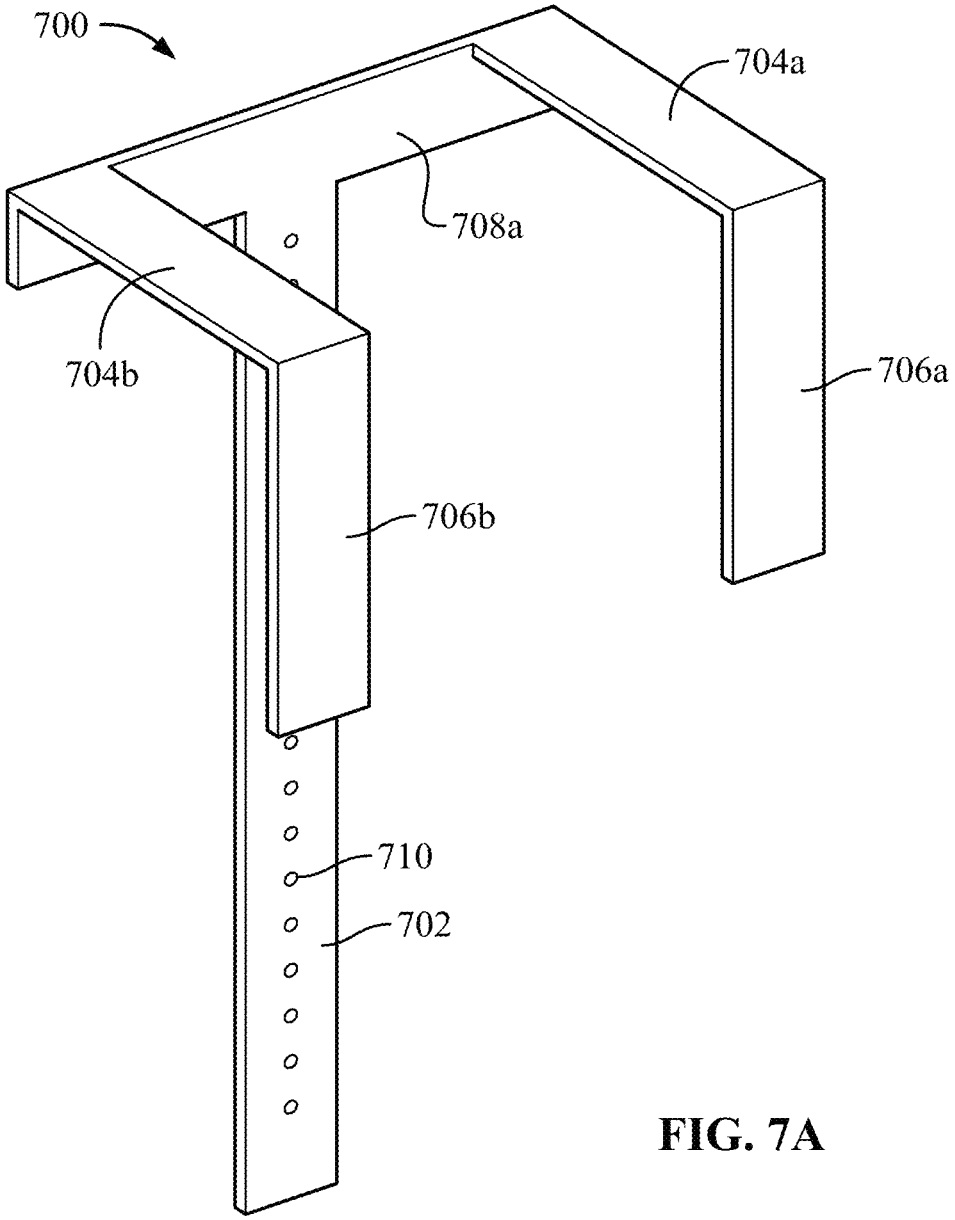
FIGS. 7A-B show different embodiments of the parapet bracket.

Referring now to FIG. 7A, another example of a parapet bracket 700 is shown. The parapet bracket 700 of FIG. 7A may have two short legs 706*a-b* that are horizontally spaced apart from each other. The two short legs 706*a-b* may hook on the parapet 102 and allow for a more secure and sturdier attachment thereon. The two short legs 706*a-b* may be connected to the long leg 702 by two connecting plates 704*a-b*. The two short legs 706*a-b* and connecting plates 704*a-b* may also allow for a better distribution of the weight of the pipe 106 on the parapet wall 102 and allow the parapet bracket 700 to handle more weight.

The plate making up the long leg 702 may have a T-shape. The upper portion 708 of the long leg 702 may extend laterally from the right and left sides of the center vertical strip of the long leg 702 having the coupling holes 710. Consequently, a T-shape may be formed where the two connecting plates 704*a-b* having the two short legs 706*a-b* may extend from the opposite ends of the T-shape. At the opposite ends of the upper portion 708, and to the right and left of the center vertical portion of the long leg 702, two connecting plates 704*a-b* may extend forward horizontally. One connecting plate 704*a-b* may extend from each opposite ends of the upper portion 708. The connecting plates 704*a-b* may each have short legs 706*a-b* extending downwards therefrom, where the short legs 706*a-b* may act as hook structures.

The parapet bracket 700 of FIG. 7A may have the same dimensions, as described elsewhere herein. By way of example and not limitation, the upper portion 708 may have a length between five and 12 inches. In some examples, the upper portion 708 may have a length greater than 12 inches. By way of example and not limitation, the upper portion 708 may have a width/height between 0.5 to three inches. In some examples, the upper portion 708 may have a width/height greater than three inches. The length of the connecting plates may also be adjustable, as described elsewhere herein.

Figure 7B:
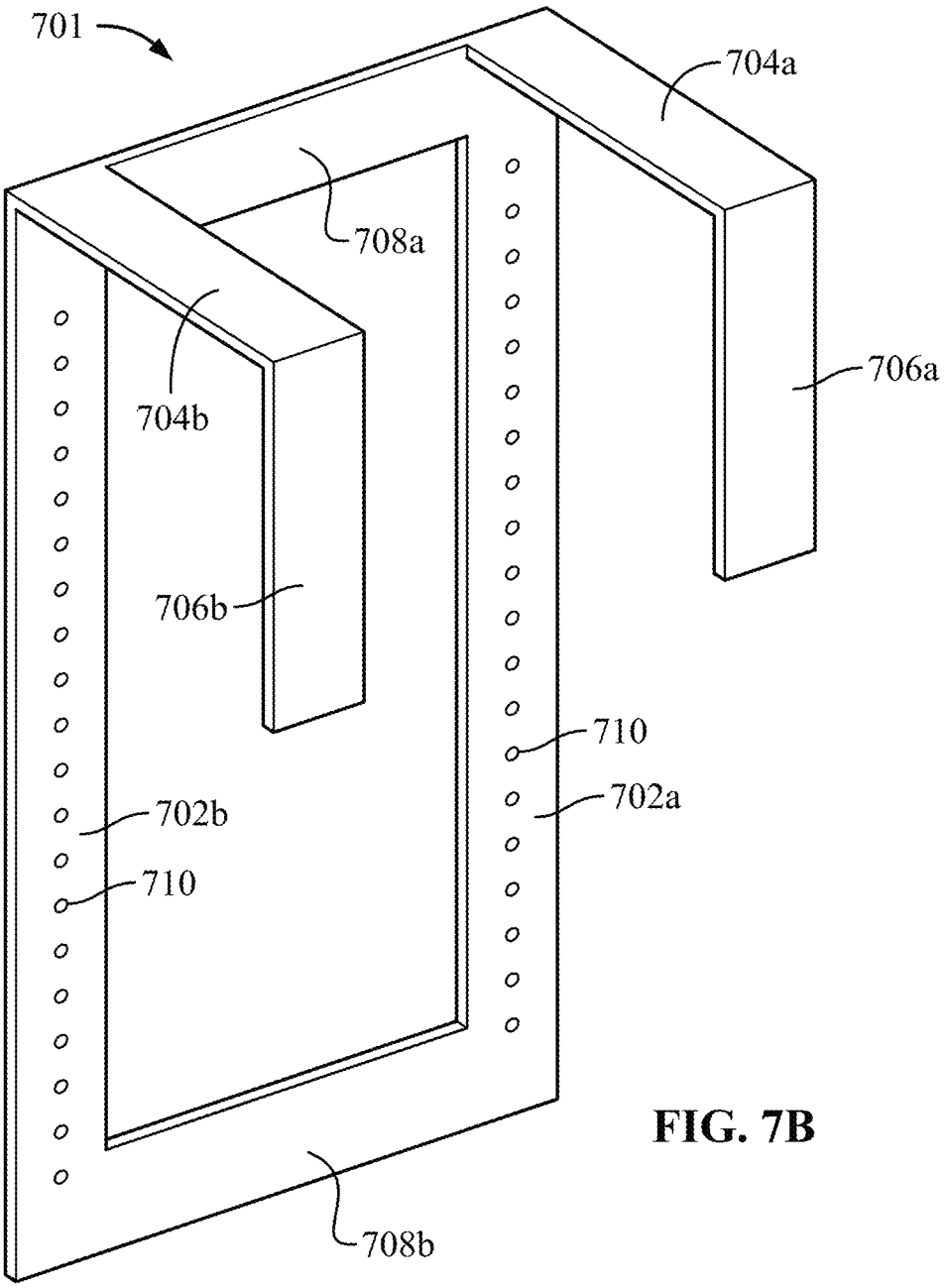

Referring now to FIG. 7B, another example of a parapet bracket 701 is shown. In addition to having two short legs 706*a-b* and connecting plates 704*a-b*, the parapet bracket 701 of FIG. 7B may also have double long legs 702*a-b* each having a column of coupling holes 710. The double long legs 702*a-b* may be useful for mounting components other than pipes 106, such as an electric box 502 (see FIG. 5), to the parapet bracket 700. The double long legs 702*a-b* may also allow for a better fastening of pipes 106 to the parapet bracket 701 using the multiple columns of coupling holes 710.

The two long legs 702*a-b* may be connected to each other at their top and bottom. A top lateral extension 708*a* may extend between and connect the long legs 702*a-b*, and a bottom lateral extension may extend between and also connect the long legs 702*a-b*. As a result, the parapet bracket 701 may have an overall rectangular plate shape with a rectangular hole about its center and two connecting plates 704*a-b*, having the two short legs 706*a-b*, extending from top corner edges of the rectangular plate. The two columns of coupling holes 710 may also extend vertically along the side-length of the rectangular plate shape. The parapet bracket 701 of FIG. 7B may have the same dimensions, as described elsewhere herein. The upper and lower lateral extensions 708*a-b* may have the same dimensions as the upper portion 708 of the parapet bracket 700 of FIG. 7A. The two connecting plates 704*a-b* of the parapet bracket 701 of FIG. 7B may also be adjustable.

FIGS. 8A-B, FIGS. 9A-B, and FIGS. 10A-B show other adjusting mechanisms for changing the length of the bracket spacing 306 (see FIG. 3A) so that the parapet bracket 100 may fit properly over the parapet wall 102. As shown in such figures, the connecting plate between the long leg 202 and short leg 206 may come in two parts 801*a-b*. The two parts 801*a-b* may include an insertable connecting plate 801*a* and a hollow connecting plate 801*b*. The hollow connecting plate 801*b* may have a cavity to receive the insertable connecting plate 801*a*. Consequently, the hollow connecting plate 801*b* may have a wider thickness 802*b* than the thickness 802*a* of the insertable connecting plate 801*a*. The wide thickness 802*b* of the hollow connecting plate 801*b* may include the thickness of the cavity within the hollow plate.

The insertable connecting plate 801*a* may be directly attached to the long leg 202 and the hollow connecting plate 801*b* may be directly attached to the short leg 206, or vice versa. To adjust the bracket spacing 306, the insertable connecting plate 801*a* may slide within the cavity of the hollow connecting plate 801*b* to widen or narrow the bracket spacing 306 to the desired length. When the desired bracket spacing 306 is achieved, the insertable connecting plate 801*a* may be secured to the hollow connecting plate 801*b*, as described elsewhere herein.

Figure 8A:
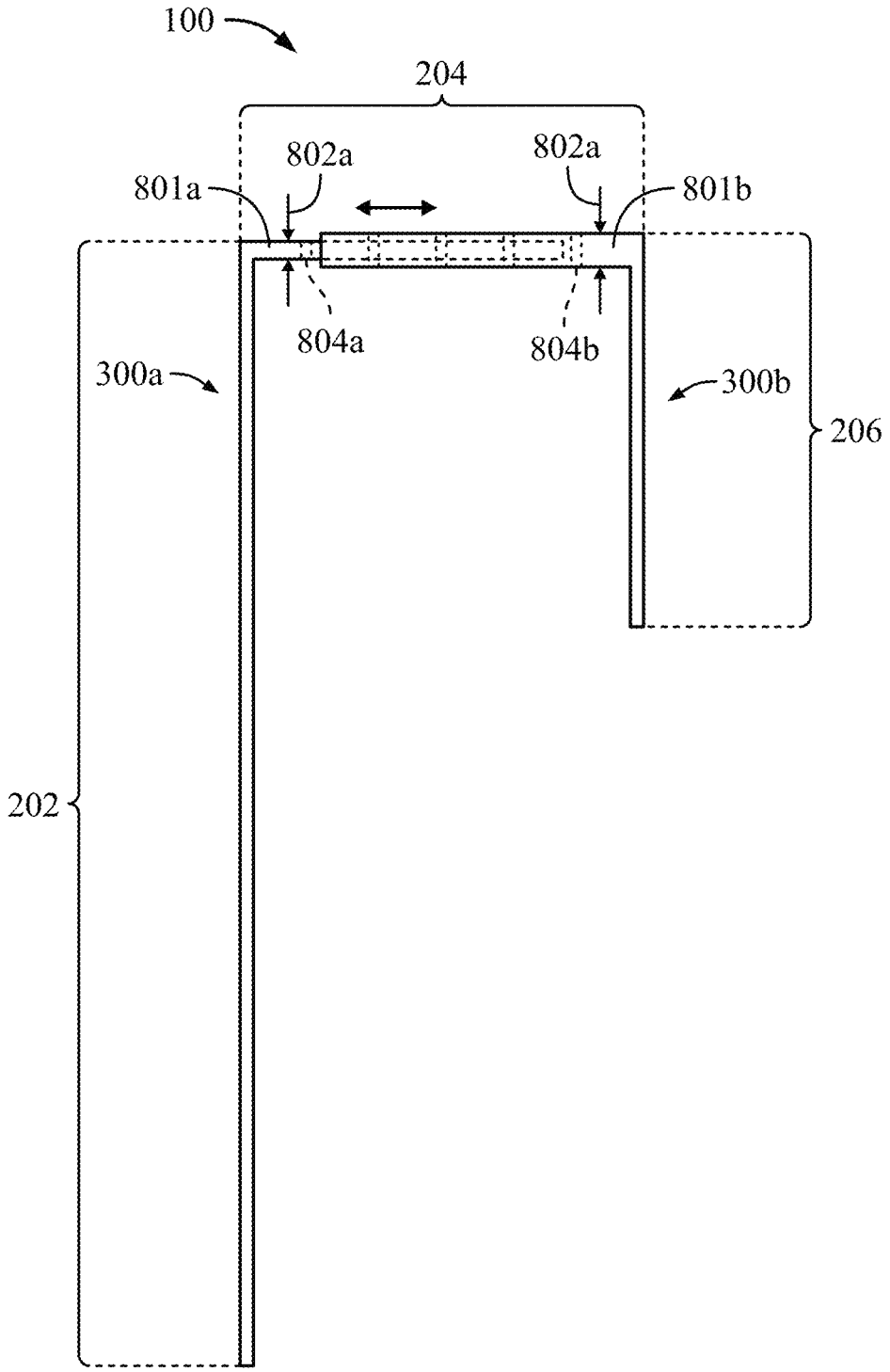
FIGS. 8A-B show another embodiment of an adjustable parapet bracket.
Figure 8B:
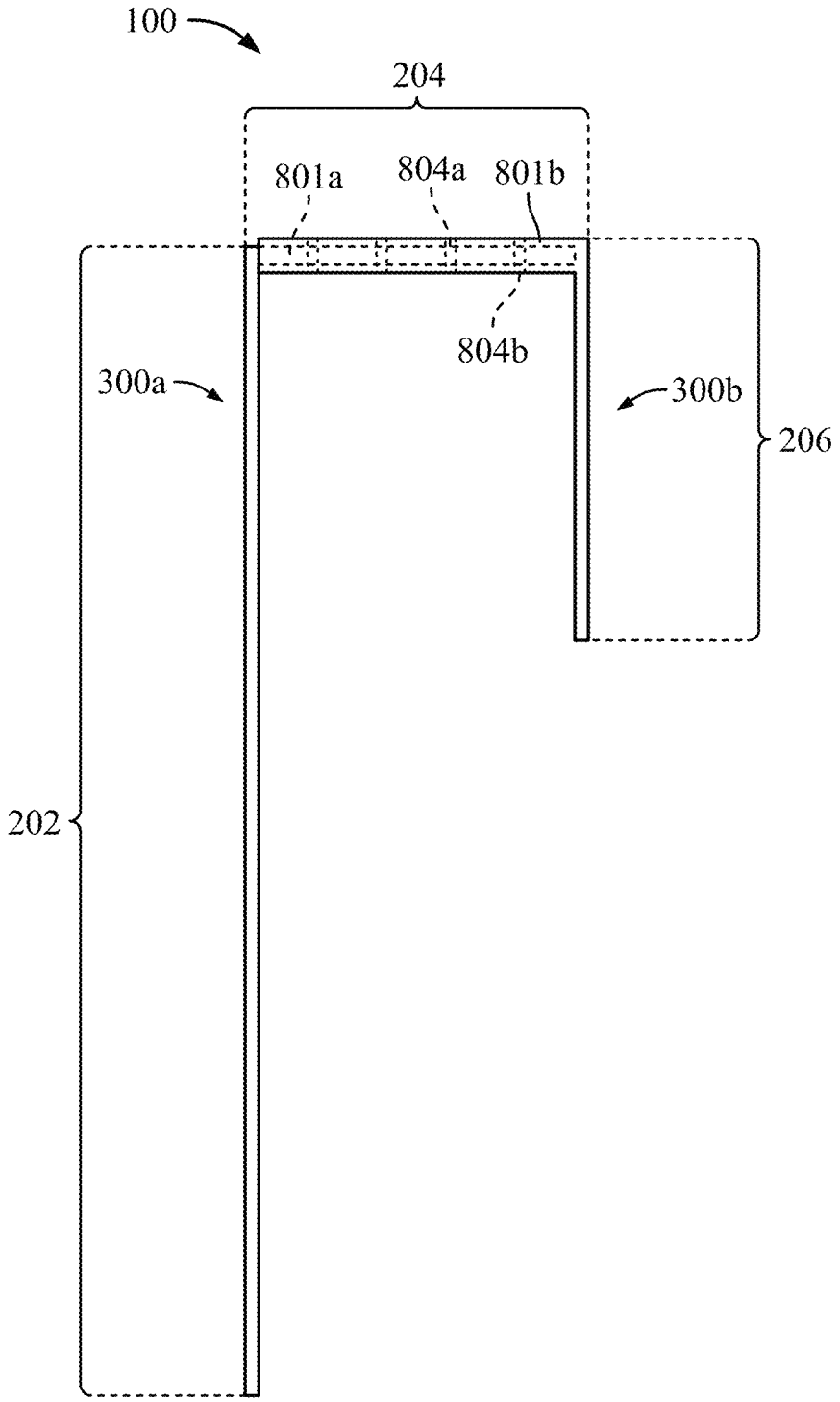

Referring now to FIGS. 8A-B, the insertable connecting plate 801*a* may be secured and affixed to the hollow connecting plate 801*b* using fastening bores 804*a-b*. The insertable connecting plate 801*a* may have a plurality of fastening bores 804*a* symmetrically spaced apart along the length of the such connecting plate. The hollow connecting plate 801*b* may have corresponding fastening bores 804*b* symmetrically spaced apart along the length of the such connecting plate to align with the fastening bores 804*a* of the insertable connecting plate 801*a*. The hollow connecting plate 801*b* may have fastening bores 804*b* on the top and bottom sides (i.e., outer and inner sides 214, 216 shown in FIG. 2A) that align with each other.

To adjust bracket spacing 306, the insertable connecting plate 801*a* may slide in or out of the hollow connecting plate 801*b* to achieve the desired length. At the desired length of the bracket spacing 306, the fastening bores 804*a-b* on the insertable and hollow connecting plates 801*a-b* may align with each other. This may be because the parapet thickness 110, which the brackets spacing 306 may equal to such thickness, may follow a standardized dimension for constructing buildings and be predetermined. When the fastening bores 804*a-b* on the insertable and hollow connecting plates 801*a-b* align with each other at the adjusted bracket spacing 306, fasteners may be used with the fastening bores to secure the two connecting plates to each other. Such fasteners may be as described elsewhere herein. By way of example and not limitation, the fastening bore 804*a* on the insertable connecting plate 801*a* may be threaded such that screws may be used to secure such plate to the hollow connecting plate 801*b*.

Figure 9A:
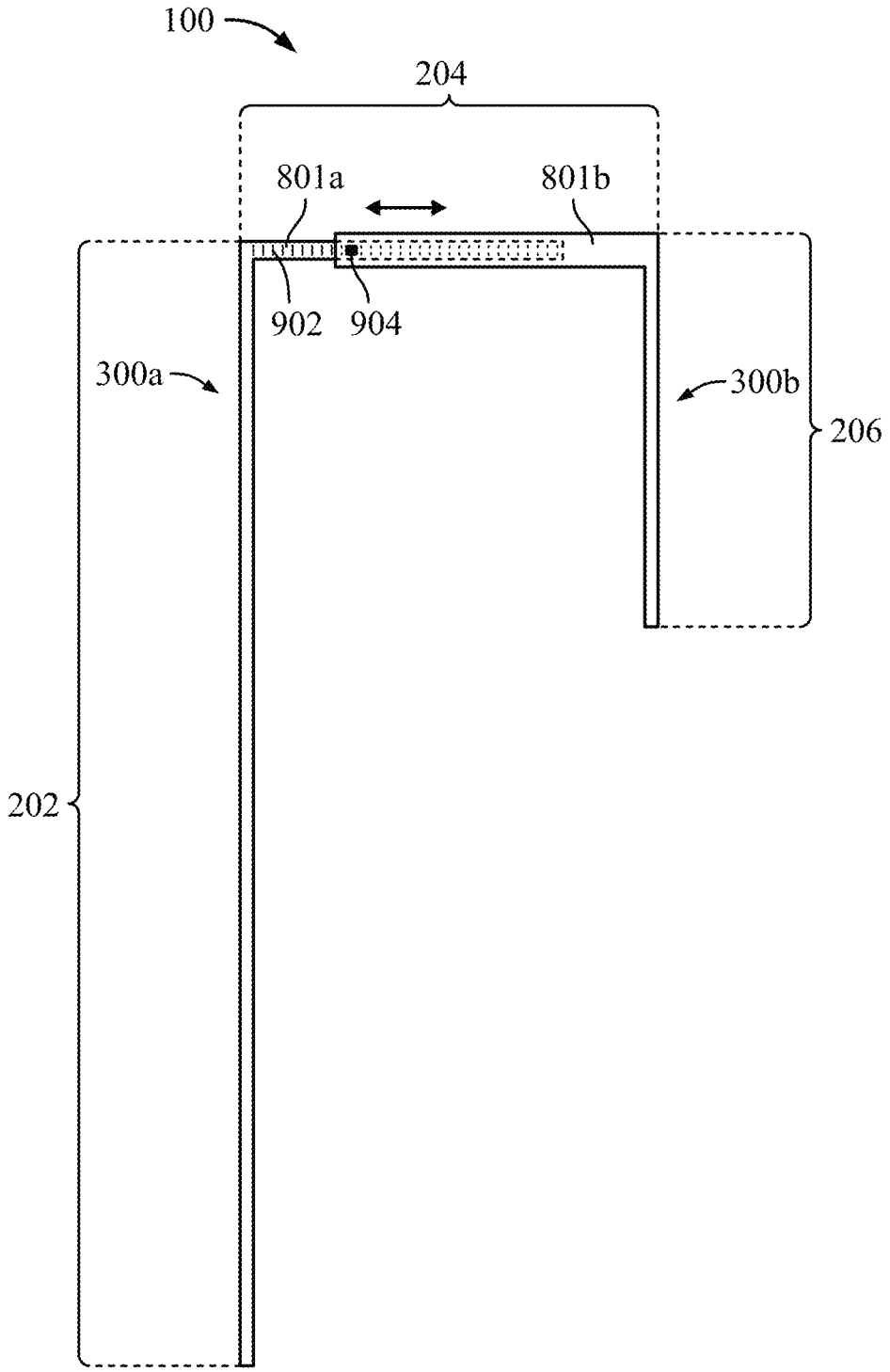
FIGS. 9A-B show another embodiment of an adjustable parapet bracket.
Figure 9B:
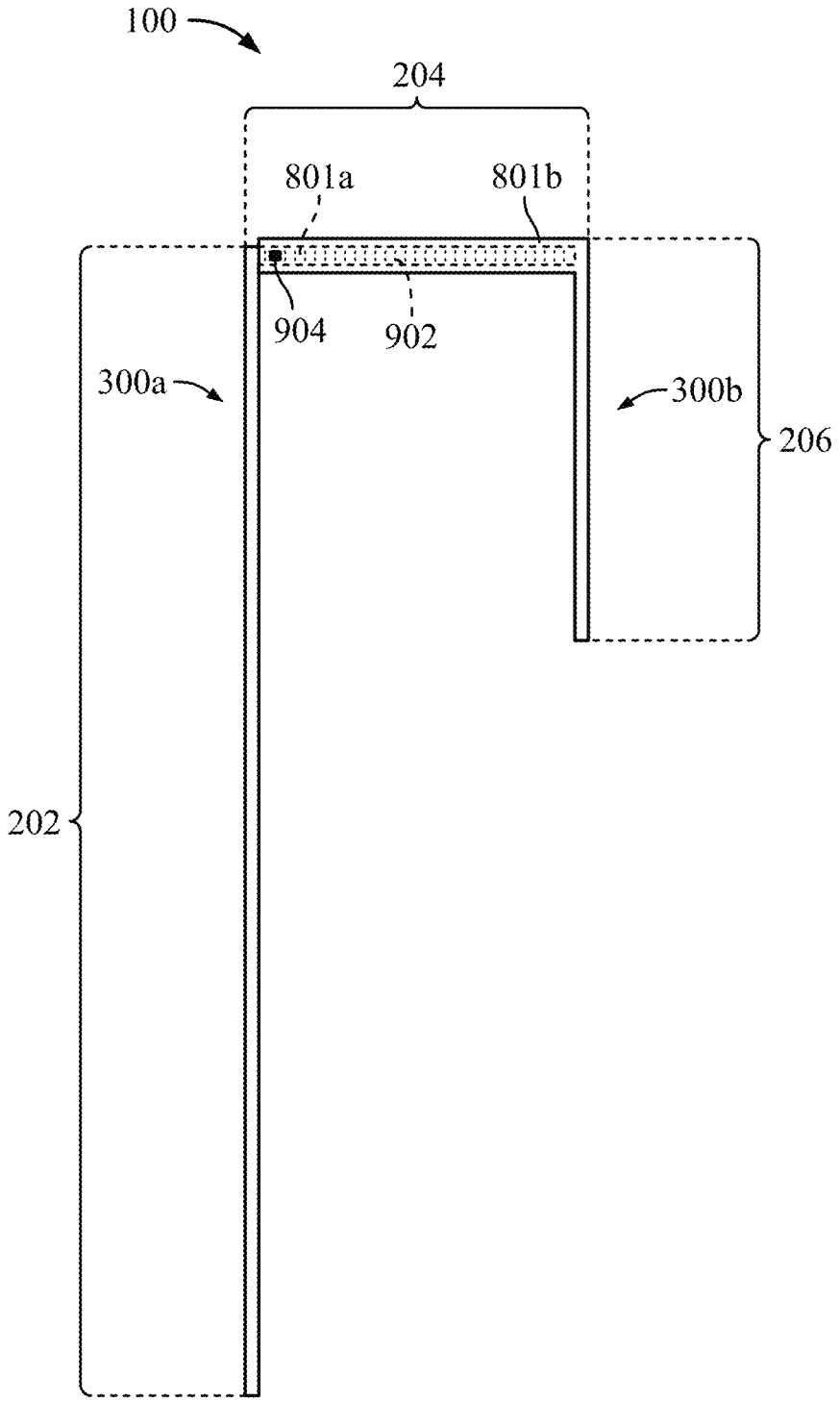

Referring now to FIGS. 9A-B, the adjusting mechanism between the insertable connecting plate 801*a* and the hollow connecting plate 801*b* may include a plurality of protruding ribs 902 and a spring-biased auto lock button 904. Two opposing outer surfaces of the insertable connecting plate 801*a* may each have a plurality of rib structures 902 with rib spacing between them, the rib structures being vertical and spaced apart from each other along the length of the insertable connecting plate 801*a*. The hollow connecting plate 801*b* may have an auto lock button 904 on its outer surface and proximate to the opening of the cavity of such plate. The auto lock button 904 may be pressed to unlatch a locking projection that is spring biased to interlock with the rib structures 902 when the button 904 is not pressed. When the auto lock button 904 is pressed, the insertable connecting plate 801*a* may freely slide inwards and outwards of the hollow connecting plate 801*b* to adjust the bracket spacing 306. When the auto lock button 904 is released, the spring-biased locking projection engages the rib structures 902 and is placed in the rib spacing. As such, the two connecting plates are affixed and secured together at the adjusted bracket spacing 306.

Figure 10A:
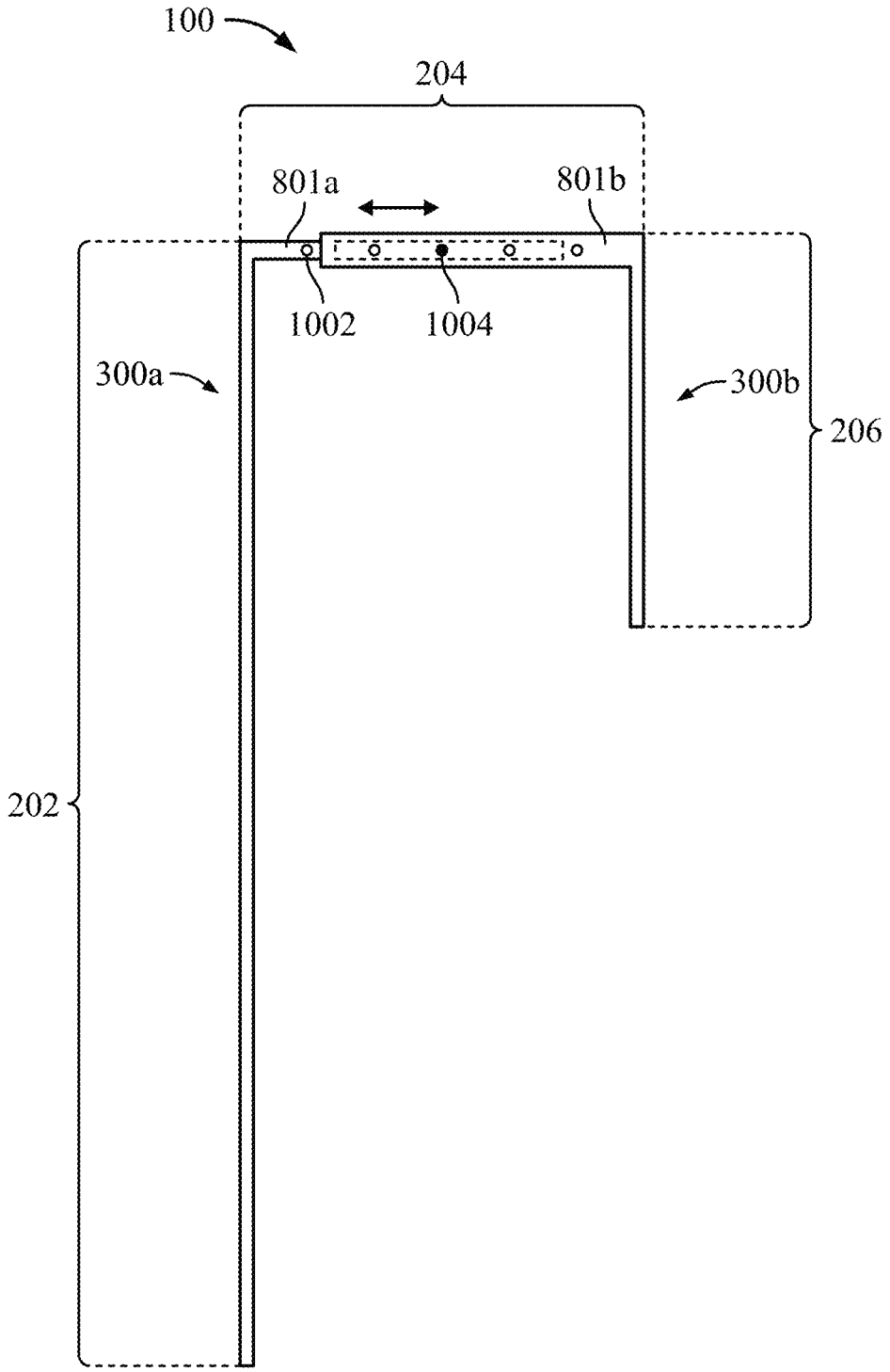
FIGS. 10A-B show another embodiment of an adjustable parapet bracket.
Figure 10B:
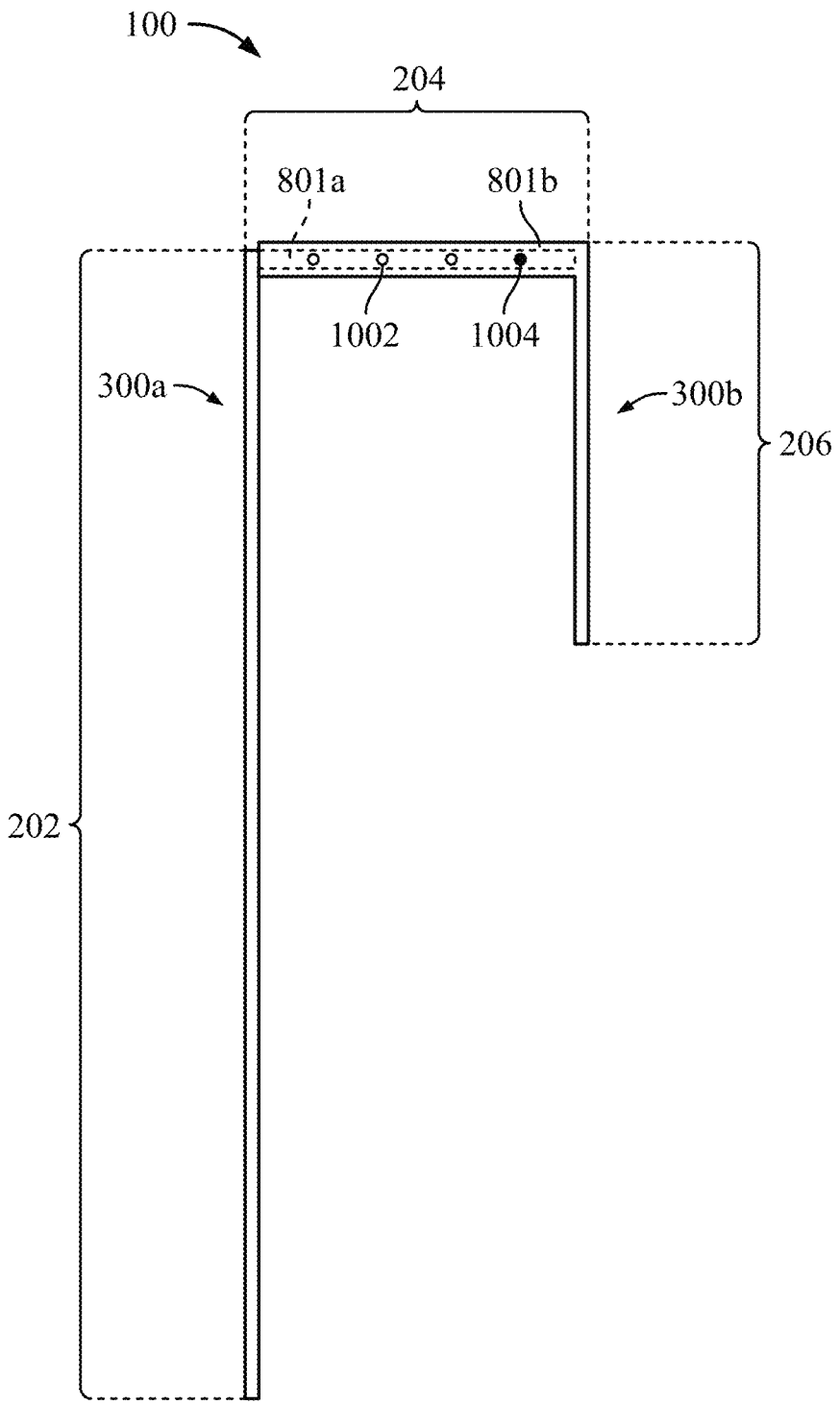

Referring now to FIGS. 10A-B, the adjusting mechanism between the insertable connecting plate 801*a* and the hollow connecting plate 801*b* may be a detent mechanism. Two spring-loaded detents 1004 may be on opposite sides of the insertable connecting plate 801*a* (e.g., left and right sides) and proximate to the outer tip of such plate. The corresponding opposite sides of the hollow connecting plate 801*b* may have a plurality of detent receiving holes 1002 symmetrically spaced along the length of such plate. By way of example and not limitation, the hollow connecting plate 801*b* may have between two to 10 plurality of detent receiving holes 1002 on each opposing side. The spring-loaded detents 1004 may be pressed in to slide the insertable connecting plate 801*a* inwards and outwards of the hollow connecting plate 801*b* to adjust the bracket spacing 306. When the detents 1004 are released, such components may spring into the detent receiving holes 1002 and interlock the two connecting plates together 801*a-b*.

Figure 11A:
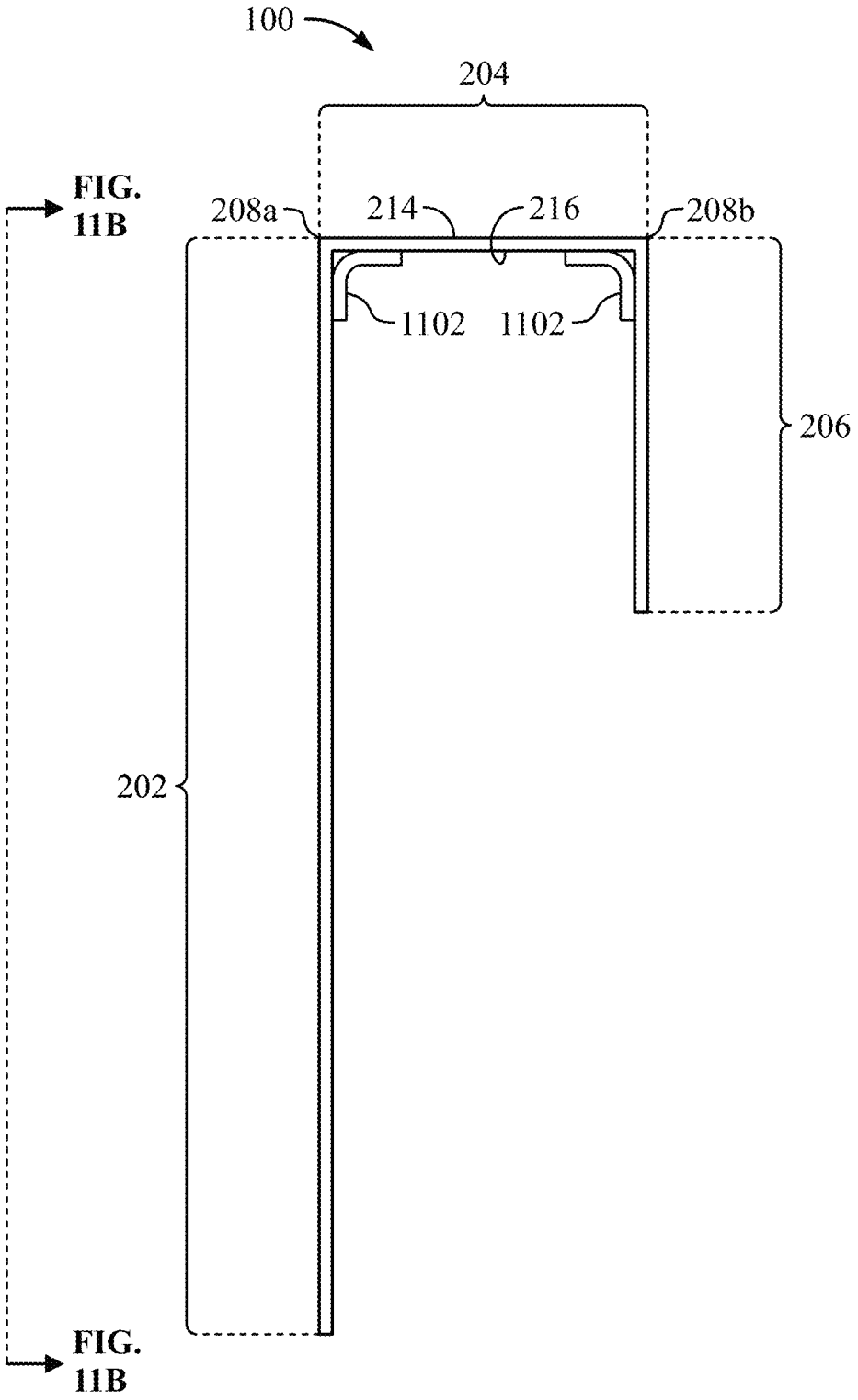
FIG. 11A shows one or more flexible membranes attached to the inside of the parapet bracket.

Referring now to FIG. 11A, and by way of example and not limitation, a flexible material 1102 (e.g., roofing membrane or foam padding) may be attached to the inner surface 216 of the parapet bracket 100 at the first and second connection edges 208*a-b*. The flexible material 1102 may be the same, as described elsewhere herein. The main difference in FIG. 11 is that the flexible material 1102 may be attached to the parapet bracket 100 such that such material may not detach and slide off of the bracket. Additionally, less flexible material 1102 may be used since such material is only attached at the inside of the first and second connection edges 208*a-b*.

Figure 11B:
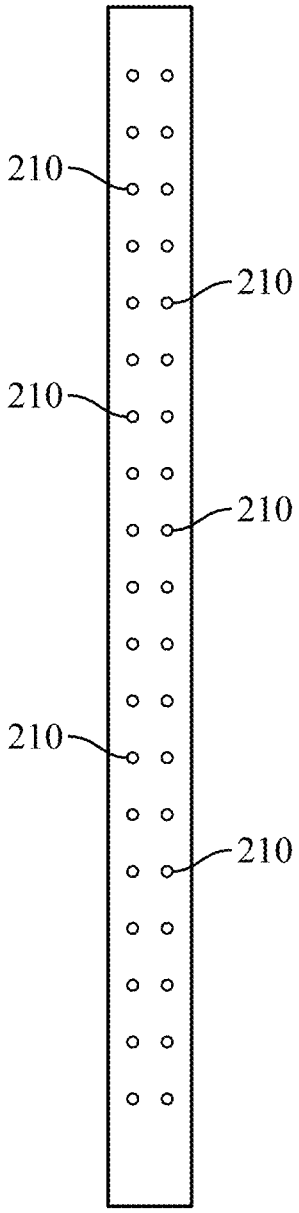
FIG. 11B shows a rear-view of the parapet bracket of FIG. 11A having more than one column of coupling holes on its long leg.

Referring now to FIG. 11B, the long leg 202 of the parapet bracket 100 may have two columns of coupling holes 210 adjacent to each other. Consequently, two pipe hangers 108 (see FIG. 4B) may be used at the same height to attach a pipe 106 to the long leg 202. Such additional fastening by a second pipe hanger 108 may be needed for pipes 106 that may be heavy and require additional reinforcement to securely hang on the bracket 100 and ultimately the parapet 102. Consequently, the parapet bracket 100 of FIG. 11B may be a heavy duty bracket that may have a bracket width 212 (see FIG. 2A) at the high end of the bracket width, described elsewhere herein, to accommodate for the second column of coupling holes 210.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of renovating a parapet of a roof and using a parapet bracket to reattach a pipe to the parapet, comprising:

removing the pipe from an interior surface of the parapet, the interior surface facing a roof deck of the roof;

cleaning the interior surface of the parapet;

coating the interior surface of the parapet with a weather-resistant coating;

hanging the parapet bracket on the parapet such that a long leg of the parapet bracket hangs vertically along the interior surface of the parapet, a connecting plate of the parapet bracket that is connected to the long leg lays horizontally on a top surface of the parapet, and a short leg of the parapet bracket connected to the connecting plate and opposite to the long leg hangs vertically along an exterior surface of the parapet, the exterior surface being opposite to the interior surface of the parapet; and coupling the pipe to an external surface of the long leg of the parapet bracket, the external surface of the long leg facing away from the parapet.

2. The method of claim 1, further comprising adjusting the connecting plate to change a bracket spacing between the long and short leg based on a thickness of the parapet before hanging the parapet bracket on the parapet.

3. The method of claim 1, wherein the pipe is coupled to the external surface of the long leg using coupling holes on the long leg of the parapet bracket and also using a pipe hanger and fasteners.

4. The method of claim 3, wherein the coupling holes are threaded and the fasteners are screws.

5. The method of claim 1, wherein the pipe is coupled to the external surface of the long leg using rectangular bores on the long leg of the parapet bracket and also using a metal zip tie.

6. The method of claim 1, wherein the connecting plate is a first connecting plate and the parapet bracket has a second connecting plate removably attached on top of the first connecting plate.

7. The method of claim 6, wherein the first connecting plate is directly attached to the long leg of the parapet bracket, and the second connecting plate is directly attached to the short leg of the parapet bracket.

8. A method of attaching a pipe to a parapet using a parapet bracket, comprising:

adjusting a bracket spacing between a long leg and a short leg of the parapet bracket by horizontally moving a first connecting plate attached to the long leg relative to a second connecting plate attached to the short leg, the bracket spacing being greater than or equal to a thickness of the parapet;

hanging the parapet bracket on the parapet such that the long leg of the parapet bracket hangs vertically along an interior surface of the parapet facing a roof deck, the first and second connecting plates of the parapet bracket lay horizontally on a top surface of the parapet, and the short leg of the parapet bracket hangs vertically along an exterior surface of the parapet, the exterior surface being opposite to the interior surface of the parapet; and coupling the pipe to an external surface of the long leg of the parapet bracket using a plurality of coupling holes on a column of coupling holes on the long leg of the parapet bracket, the external surface of the long leg facing away from the parapet.

9. The method of claim 8, further comprising inserting a flexible membrane between the parapet bracket and the parapet.

10. The method of claim 8, wherein the first connecting plate has a first set of teeth structures along a length of the first connecting plate, and the second connecting plate has a second set of teeth structures along a length of the second connecting plate, the first and second set of teeth structures configured to engage each other after adjusting the bracket spacing to be greater than or equal to the thickness of the parapet.

11. The method of claim 10, wherein the first connecting plate has a first plurality of fastening holes along the length of the first connecting plate, and the second connecting plate has a second plurality of fastening holes along the length of the second connecting plate.

12. The method of claim 11, wherein the first and second connecting plates are fastened to each other using the first and second plurality of fastening holes after adjusting the bracket spacing between the long leg and the short leg of the parapet bracket.

13. The method of claim 8, wherein the plurality of coupling holes are threaded and screws are used to couple the pipe to the external surface of the long leg.

14. The method of claim 8, wherein a metal zip tie is used with the plurality of coupling holes to couple the pipe to the external surface of the long leg.

* * * * *